US010471450B2

(12) United States Patent
Kruse et al.

(10) Patent No.: US 10,471,450 B2
(45) Date of Patent: Nov. 12, 2019

(54) DEVICE FOR COATING SURFACES, PARTICULARLY COLOURED OR PAINTED SURFACES

(71) Applicant: SATA GMBH & CO. KG, Komwestheim (DE)

(72) Inventors: Albrecht Kruse, Stuttgart (DE); Norbert Maier, Allmersbach LT. (DE); Peter Dettlaff, Remseck (DE); Daniel Maier, Boeblingen (DE); Gabriele Szedzinski, Ludwigsburg (DE)

(73) Assignee: SATA GMBH & CO. KG, Kornwestheim (DE)

( * ) Notice: Subject to any disclaimer, the term of this patent is extended or adjusted under 35 U.S.C. 154(b) by 0 days.

(21) Appl. No.: 15/575,585

(22) PCT Filed: May 17, 2016

(86) PCT No.: PCT/EP2016/000809

§ 371 (c)(1),
(2) Date: Nov. 20, 2017

(87) PCT Pub. No.: WO2016/188618

PCT Pub. Date: Dec. 1, 2016

(65) Prior Publication Data

US 2018/0147586 A1 May 31, 2018

(30) Foreign Application Priority Data

May 22, 2015 (DE) ..... 10 2015 006 483

(51) Int. Cl.
*B05B 7/24* (2006.01)
*B05B 7/04* (2006.01)
(Continued)

(52) U.S. Cl.
CPC ..... *B05B 7/241* (2013.01); *B05B 7/0416* (2013.01); *B05B 7/2478* (2013.01); *B05B 12/02* (2013.01); *B05B 9/0833* (2013.01); *B05B 9/0838* (2013.01)

(58) Field of Classification Search
CPC ..... B05B 7/0416; B05B 7/241; B05B 7/2478; B05B 12/02
(Continued)

(56) References Cited

U.S. PATENT DOCUMENTS 2,595,317 A * 5/1952 White, Jr. ..... B05B 9/0833 222/80
3,270,920 A * 9/1966 Nessler ..... B05B 7/2472 222/136
(Continued)

FOREIGN PATENT DOCUMENTS

EP 2669213 A1 12/2013
WO 2009054986 A1 4/2009
WO 2010044864 A1 4/2010

OTHER PUBLICATIONS

Application filed Dec. 2, 2014 for Design U.S Appl. No. 29/510,723.
(Continued)

*Primary Examiner* — Vishal Pancholi
(74) *Attorney, Agent, or Firm* — Paul D. Bianco; Gary S. Winer; Fleit Intellectual Property Law

(57) ABSTRACT

A device for coating surfaces, particularly colored or painted surfaces, using a spray gun which is supplied by a supply device with the material to be sprayed. The supply device includes a material container which can be pressurized, and a pressure element is provided on or in the material container itself.

29 Claims, 22 Drawing Sheets

(51) Int. Cl.
*B05B 12/02* (2006.01)
*B05B 9/08* (2006.01)

(58) Field of Classification Search
USPC .... 222/95, 105, 464.6, 464.7, 402, 326, 340
See application file for complete search history.

(56) References Cited

U.S. PATENT DOCUMENTS 5,713,519 A * 2/1998 Sandison ..... B05B 7/0846 239/307
5,797,520 A * 8/1998 Donahue ..... B05B 9/047 222/386.5
6,820,824 B1 * 11/2004 Joseph ..... B05B 7/2408 239/302
7,798,427 B2 * 9/2010 Joseph ..... B05B 7/2408 141/2
2009/0108089 A1 * 4/2009 Handzel ..... B05B 7/241 239/8
2012/0043352 A1 * 2/2012 Rasmussen ..... B67D 1/0412 222/386.5
2012/0267388 A1 * 10/2012 Tom ..... B65D 83/0055 222/1
2013/0001317 A1 * 1/2013 Staunton ..... B05B 7/2408 239/1
2014/0131380 A1 * 5/2014 Pethe ..... B67D 7/0255 222/95

OTHER PUBLICATIONS

Restriction Requirement dated Nov. 3, 2015 for Design U.S Appl. No. 29/510,723.
International Preliminary Report on Patentability dated Nov. 28, 018 for PCT/EP2016/000809.
International Search Report dated Jul. 14, 2016 for PCT/EP2016/000809.
Written Opinion dated Aug. 4, 2016 for PCT/EP2016/000809.
Notice of Allowance dated Jan. 27, 2016 in U.S. Appl. No. 29/510,723.

* cited by examiner

DEVICE FOR COATING SURFACES, PARTICULARLY COLOURED OR PAINTED SURFACES

FIELD OF THE INVENTION

The invention relates to a device for coating surfaces, particularly colored or painted surfaces, comprising a spray gun which can be supplied by means of a supply device with at least one liquid material to be sprayed.

The term "spray gun" is primarily used for devices which are provided for the industrial application of liquids which, following drying, impart to the coated article a particular visual appearance and/or particular protection with respect to external influences, such as weathering, mechanical wear and others.

BACKGROUND

Both purely hand-operated spray guns and spray guns that can be operated by means of automatic means and/or robots are known. By means of spray guns, for example vehicles of any type, ships, aircraft, rooms and furniture can be painted. For filler paints, topcoat paints, solid-color paints, basecoat paints and clear lacquers in the auto repair sector, diverse spray gun models are available for selection; the guns can generally be used both for solvent-containing paints and also for water-based paints. The application of multiple paint layers is usual. The paints can consist of one component (single-component paints) or of multiple components (multi-component paints, reaction lacquers).

Spray guns also have an area of use in distributing adhesives on surfaces of any type which are to be joined to each other. In professional painting, spray guns can be used to apply spray fillers. In road construction, spray guns are used to apply marking lines or the like. Even in the foodstuffs sector they are used, for example, in the decoration of cakes or tarts. In addition, it is known to coat textiles (e.g. coated garments) and leather (e.g. auto seats and shoes) by means of spray guns.

Accordingly, the liquid coating material can have a higher or lower viscosity.

The material supply device can have different material containers, depending on the customer requirements and/or depending on the nature of the liquid material. The material feed to the spray gun can be carried out without pressure or else with pressure, depending on the system.

In many spray guns, the material containers in the basic configuration have the shape of a cylinder or a cone and, because of this configuration, are therefore in general and also at this point designated as "cups". The following types of cup are known:

I. Flow Cups:

Here, the force of gravity and the natural flowing power of liquid material are used. Therefore, in the working position, the cup is located above the spray gun. The material flows out of an outlet out of the cup, wherein the outlet is provided either in the cup base or, in so-called "upside-down" spray gun cups, in the cup cover, into the spray gun from above and, after that, along or within a color needle as far as a nozzle. Following the exit from the nozzle, it is distributed on the surface to be coated. In the case of a compressed air operated spray gun, the material to be sprayed is entrained by the air flowing past the nozzle of the spray gun. Such flow cups are used comprehensively in the motor vehicle repair trade, in joinery workshops, furniture work stops and other handcraft and industrial operations.

Both flow cups made of metals (e.g. from aluminum) or else plastics are known and as usual. Plastic cups are frequently preferred since, as a rule, they have a lower weight than metal cups.

II. Pressure Cups:

Here, the flow cup located on the spray gun is additionally pressurized. The material is therefore, so to speak, forced to flow towards the nozzle. Such pressure cups are generally used when a highly viscous or relatively highly viscous liquid is to be sprayed and the quantity of liquid to be sprayed is less than about 1 liter.

III. Suction Cups:

Here, the cup is arranged underneath the gun. A riser tube (suction tube) extends through the cup. The air flowing past along the tube draws the material, so to speak, into the spray gun as a result of the so-called Venturi effect.

IV. Pressure Vessel:

In the case of high quantities of liquid to be sprayed, pressure vessels having a volume of about 2-5 liters are frequently used but vessels of about 50-100 liters and even larger vessels can also be obtained. The material is generally supplied directly to the spray gun through a delivery hose.

V. Spraying Methods without Cup or Vessel Fixed to the Spray Gun:

So-called "airless spray guns" manage entirely without a cup. Here, by means of a pump that is operated electrically, pneumatically or by means of an internal combustion engine, the liquid material to be sprayed from a separate vessel or other container is pressurized via a hose, tube or funnel by a diaphragm or a piston. In this way, a defined quantity can thus generally be led through a high-pressure hose as far as the nozzle of the spray gun. However, air-assisted airless spray guns are also known. Here, the material to be sprayed in the nozzle area is additionally pressurized with at least one compressed air stream. Furthermore, there are also so-called "cartridge guns". These guns also manage entirely without a cup; by using these, for example, material-filled film bags which are used in the actual gun can be pressed out. As a rule, in such guns, a hand lever is provided in the rear area, with which a rod can be forced against a movable base of the cartridge from behind. Following actuation of the hand lever, the base moves into the interior of the cartridge and presses the material located in the cartridge forward out of a nozzle. The rod can be prevented from slipping back by means of a retaining clip or the like.

In cartridge guns, there are pure handheld pressure guns and also those with compressed air operation. In the latter guns, the material is arranged in a pipe. In one embodiment, the compressed air can act directly on the cartridge base from behind. In another embodiment, provision is made for compressed air to press on the cartridge base indirectly via a telescopic piston or a pressure rod with pressure plate or the like.

In addition, in cartridge guns and spray guns in general, an electric accumulator can be provided. Particularly high pressures can be produced thereby.

Spray gun cups that can be arranged above the spray gun, in which a compressed air connection is provided in the cover, are known from practice. A compressed air hose can be connected to this connection. As a result, the liquid located in the interior of the spray gun cup, can be pressurized, so that it can be led through the spray gun to the spray nozzle more quickly than with the aid of the force of gravity on its own.

Such spray gun cups are very well suited for the material supply to the spray gun with highly viscous or relatively highly viscous liquids. During handling, however, the compressed air hose, which extends laterally at a distance along the spray gun cup, sometimes interferes. In order at every time to ensure flawless function and safety of the pressure cup, safety valves, pressure setting valves, nonreturn valves or other material back-flow preventers must additionally be provided on these cups. The additional components require additional mounting steps and/or working steps by the user. The additional components make the material container more expensive and also increase its weight.

SUMMARY OF THE INVENTION

An aspect of the invention is a device for coating surfaces, particularly colored or painted surfaces, which has a material container that can be operated as simply as possible for liquid to be sprayed and which can be pressurized.

Embodiments that relate to this aspect of the invention as disclosed herein. The fact that the pressure element is provided on or in the material container itself means that disruptive additional components on the material container are dispensable. The pressure element can be provided in the interior of the material container, on its cover or inside an outer wall or outside an outer wall.

If the pressure element is formed as a gas bag, the weight of the material container is at most slightly loaded. Film bags or the like are suitable as a gas bag. The in particular proposed configuration of the gas bag as a bellows, i.e. as an elastic body made of rubber, plastics or leather that can be collapsed "in the manner of an accordion", has a positive effect both on the operational reliability and also a positive effect on the visual appearance of the material container.

In a further refinement of the invention, the configuration of the pressure element as a gas cartridge for the use of a gas cartridge as a pressure element is proposed. Here, a gas cartridge is understood to mean a small container, normally a disposable container, which is filled with liquid gas. The liquid gas can be butane, isobutane, propane or a mixture of these gases. It is firstly proposed to clip such a cartridge into the material container. Secondly, it is proposed to fix such a cartridge to the cover or to the base of the material container. The cartridge can be formed as a screw-valve cartridge. Such a cartridge is provided with a thread which can be screwed onto a corresponding connection. The valve opens only when the connection is screwed on. Such a cartridge can therefore be mounted and demounted again at any time.

However, particular advantages with regard to handling result if use is made of a cartridge which is pierced automatically during use (pierceable cartridge). Such a cartridge needs no valve. Instead, for example a spike can pierce the cartridge as soon as it is inserted into the material container.

On the market, however, relatively large-volume cartridges can in particular be obtained. In such an inventive device, as a rule no very large volumes but normally only volumes of under 1 liter have to be sprayed. For this reason, at this point the use of a spray can as pressure element or pressure generator is particularly recommended. Spray cans with smaller volume contents can also be obtained on the market.

The use of a pressure element which is formed as a solid body or which has a solid body is likewise advantageous. The solid body can be a pressure pad which can act on the outer wall of the material container. In this variant, it is however necessary that the solid body is, so to speak, continuously lashed firmly with a strap or pressed against the outer wall in another way or has to be moved along this outer wall in order to be able to exert pressure on the interior of the material container.

Particularly advantageous is the use of spring elements proposed in a further refinement of the invention. Here, the use of an initially closed box with a spring which is joined to a solid body is suitable. As soon as the cover of the box is released, the box springs open, the solid body springs out and displaces the liquid to be sprayed into the spray gun. Here, the solid body can be an actual solid body or else expanding plastic foam. The detachment of the cover of the box can particularly advantageously be carried out automatically. For this purpose, for example, a mechanical, chemical or electronic timing device can be used.

In general, it is proposed to initiate the pressurization by means of a mechanical, chemical or electronic timing device or clockwork mechanism.

In another refinement of the invention, an intermediate floor that is moveable within the material container, in particular displaceable, can be provided. The intermediate floor can be moved solely by compressed air or, for example, via an additional element such as a plunger or the like. The plunger can be fixed to the cover or to the base of the material container.

In another variant, the pressure generation by means of gas development by a chemical substance is proposed. In an advantageous variant, the pressure element is arranged in the interior of the material container. The gas can then act directly on the liquid to be sprayed and possibly even assist its flow through the color spray gun. Of course, in this variant, it is necessary to take care that the chemical substance and the liquid to be sprayed do not react with each other; the use of so-called inert gases in any case provides particular safety.

In order to accelerate the flow of the material to be sprayed into the spray gun, low pressure (vacuum) can also be applied additionally or on its own.

It is proposed to provide an adapter between the spray gun and the material container, via which the pressure change in the material to be sprayed is effected. The vacuum can be effected via the adapter. It can be generated previously by means of an external component, such as a vacuum pump. However, it is particularly advantageous if the vacuum is generated via an air stream which is branched off from a secondary air stream of the compressed air supply of the spray gun.

In a further refinement of the invention, it is proposed to equip a pressure connection in the interior of the material container with a nonreturn valve, in particular with a duckbill valve with nonreturn function.

BRIEF DESCRIPTION OF THE DRAWINGS

Further details and refinements of the invention can be seen from the remaining sub-claims and from the following exemplary embodiments explained by using drawings.

In the drawings.

DETAILED DESCRIPTION OF THE INVENTION

Figure 1:
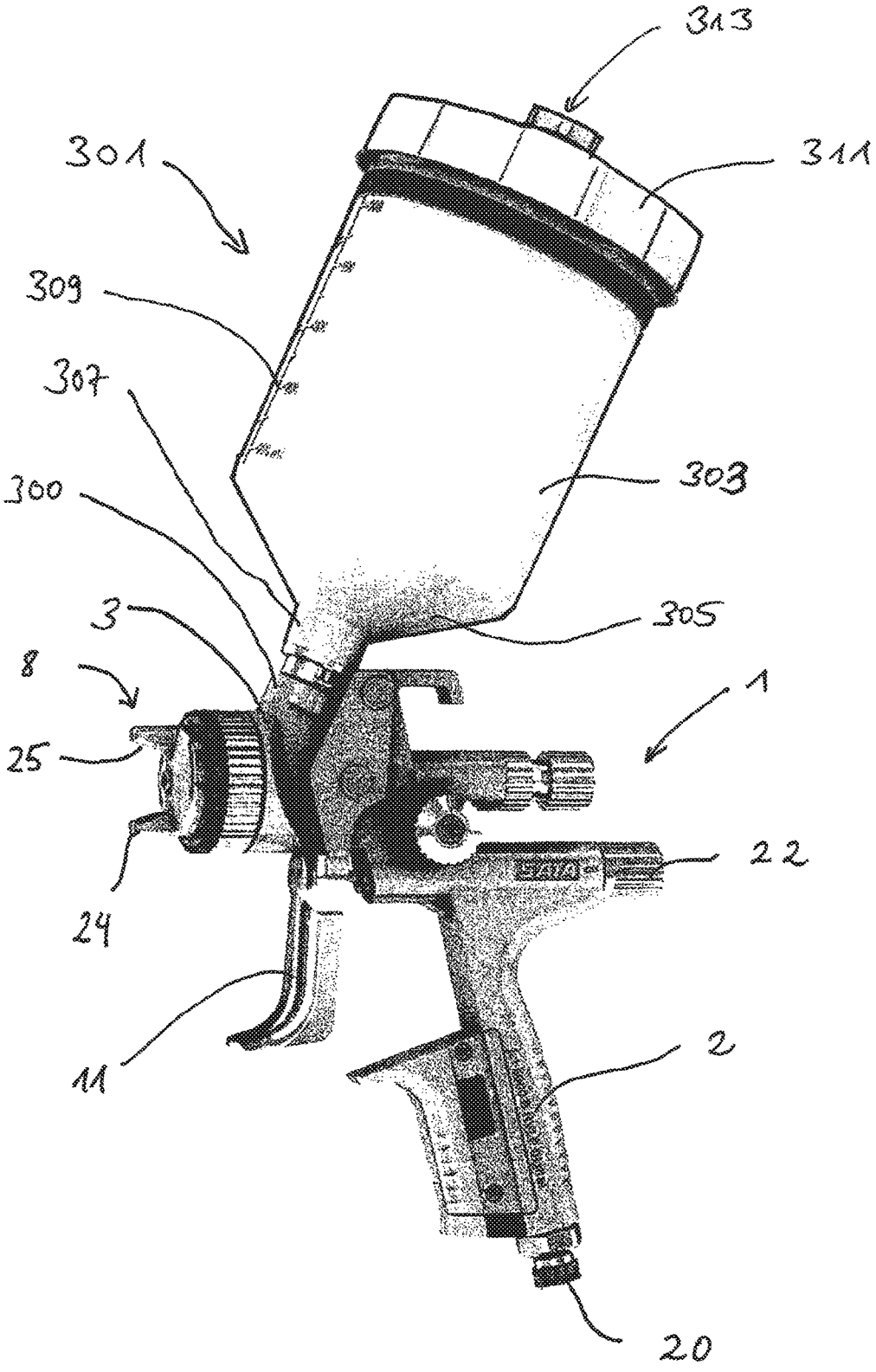
FIG. 1 shows a side view of a spray gun with a conventional flow cup.

The spray guns according to FIGS. 1 to 4 are compressed air operated color spray guns. Each spray gun has a gun body 1 with a handle area 2 and a head 3. These two sub-areas 2 and 3 extend at an angle of about 100 degrees relative to each other, as is usual. The handle area 2 has at its lower end a compressed air connection 20. Multiple air ducts 21, which end at the front end 8 of the head 3 of the spray gun, extend from the compressed air connection 20 through the handle area 2 and through the head 3. The volume and the pressure of the air flowing through these air ducts 21 can be regulated in the usual way by means of an air micrometer 22. The front end 8 of the head 3 is equipped with an air nozzle 23, which has protruding horns 24 with openings 25. An air nozzle ring 26 retains the air nozzle 23 on the head 3 of the gun body 1.

The material to be sprayed is led through the front end 8 of the head 3 of the spray gun, in which a passage opening 9 for a color needle 10 is provided at the center. When the spray gun is not in use, the front end 8 of the head 3 is closed by a mechanism. The mechanism can be actuated by means of a trigger 11; the volume of material can be regulated via a device which has a regulating screw 12. The mechanism for the trigger 11 and the color needle 10 can be actuated in a force-fitting manner via springs, not illustrated.

Figure 2:
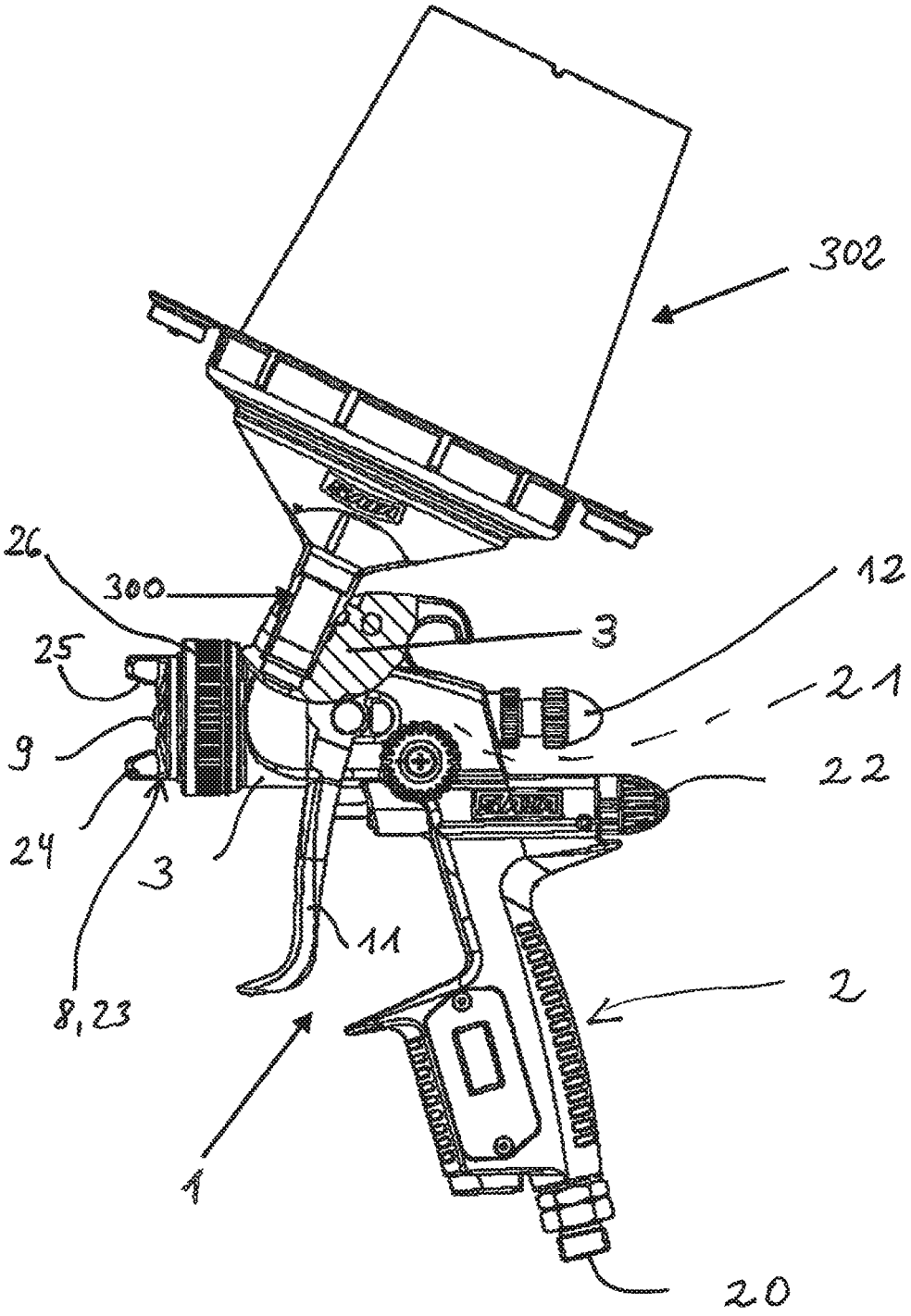
FIG. 2 shows a side view of a spray gun with an "upside-down" flow cup.

In the exemplary embodiments according to FIGS. 1 and 2, in each case a connecting piece 300 for a container 301 or 302 for the material to be sprayed is provided on the upper side of the head 3 of the spray gun 1. The connecting piece 300 is cylindrical and can have a thread, preferably an internal thread, in particular an internal thread which extends approximately over 180 degrees. Such a connection for the liquid material container is known, for example, from European patent EP 1 412 669 B1 of the applicant; the container 302 for the material to be sprayed is known as a so-called "RPS cup" from the applicant, of which details are likewise protected by a number of patents.

Closer details of the spray gun illustrated in FIG. 1 will not be described further at this point. It is the color spray gun model from the applicant known as "SATAjet 5000 B digital"; the details not specifically described here can be read in its associated operating instructions.

In the exemplary embodiment according to FIG. 1, the liquid material container 301 is an in principle conventionally configured flow cup with a volume content of about 600 ml. The flow cup 301 consists of a plastic material. It has a cylindrical main body 303. Close to its lower end, the cylinder 303 merges into a truncated cone 305, which adjoins a cylindrical connecting piece 307 with a small diameter, via which the liquid material container 301 engages in the connecting piece 300 of the spray gun. On the cylindrical main body 303 there is at least one measuring scale 309. At its upper end, the cylinder 303 is provided with a screw thread and closed by means of a screw cover 311. The screw cover 311 is equipped with a ventilation mechanism in its center 313.

If specific, as a rule relatively highly viscous, liquids are to be sprayed, it may be that the force of gravity is not adequate to lead sufficient liquid to the passage opening 9 in the spray gun 1.

The subject of the invention is therefore that a pressure element is provided on or in the liquid material container itself.

Figure 5:
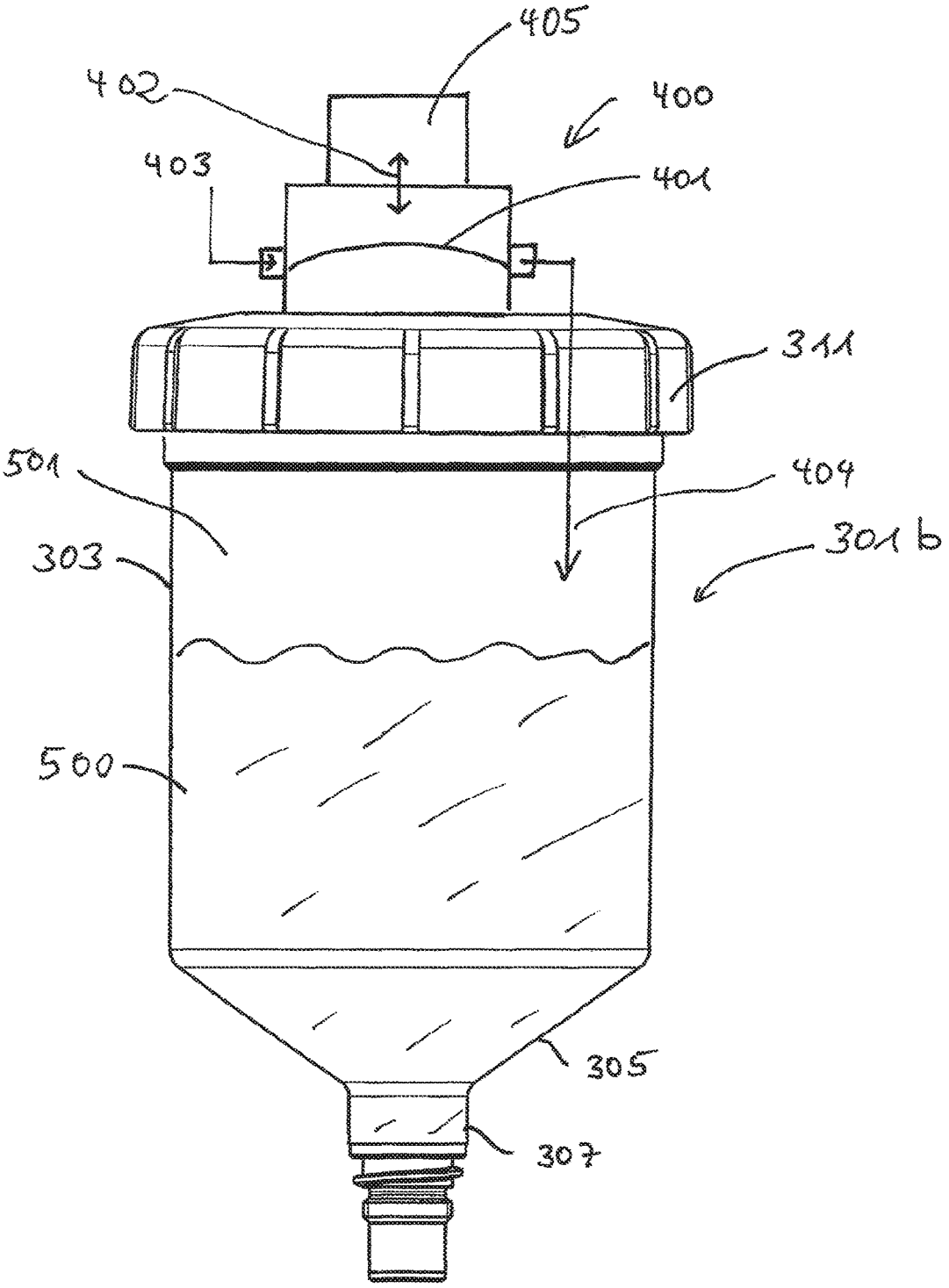
FIGS. 5 to 10 and 21 each show a view of a conventional flow cup configured in accordance with the invention, FIGS. 11 to 18 and 22 each show a view of an "upside-down" flow cup configured in accordance with the invention.

Shown in FIG. 5 is an exemplary embodiment in which the flow cup 301 shown in FIG. 1 is configured in accordance with the invention. In this flow cup 301*b*, the same details as in the flow cup 301 according to FIG. 1 are designated by the same designations, the description of which can be taken from FIG. 1. The flow cup 301*b* is approximately half-filled with a relatively highly viscous paint liquid 500. In the flow cup 301*b* according to the invention, a pump 400 is used in the center 313 of the cover 311, acting in a supporting manner to the force of gravity to lead the highly viscous liquid to the spray nozzle of the spray gun.

In the present exemplary embodiment, the pump 400 is simply inserted into the center 313 of the cup cover 311 having a correspondingly large opening, and can therefore easily be removed again.

The pump 400 is configured as a displacement pump, to be specific as an electrically drivable diaphragm pump. It has a diaphragm 401 which can then deflect in the direction of arrow 402, i.e. upward and downward. By means of the controllable drive 405, the action of a force 403 on the diaphragm 401 can be effected, if necessary via valves, so that said diaphragm folds downward, as a result of which in turn a compressive force 404 acts on the liquid 500 through the air 501 in the cup 301*b*. As a result, the liquid 500 is forced well into the connecting piece 307 and onward into the spray gun.

The described type of pressure generation has the advantage that simple pressure setting/pressure adjustment with limiting is ensured via the drive with high safety with respect to an undesired positive pressure.

Figure 6:
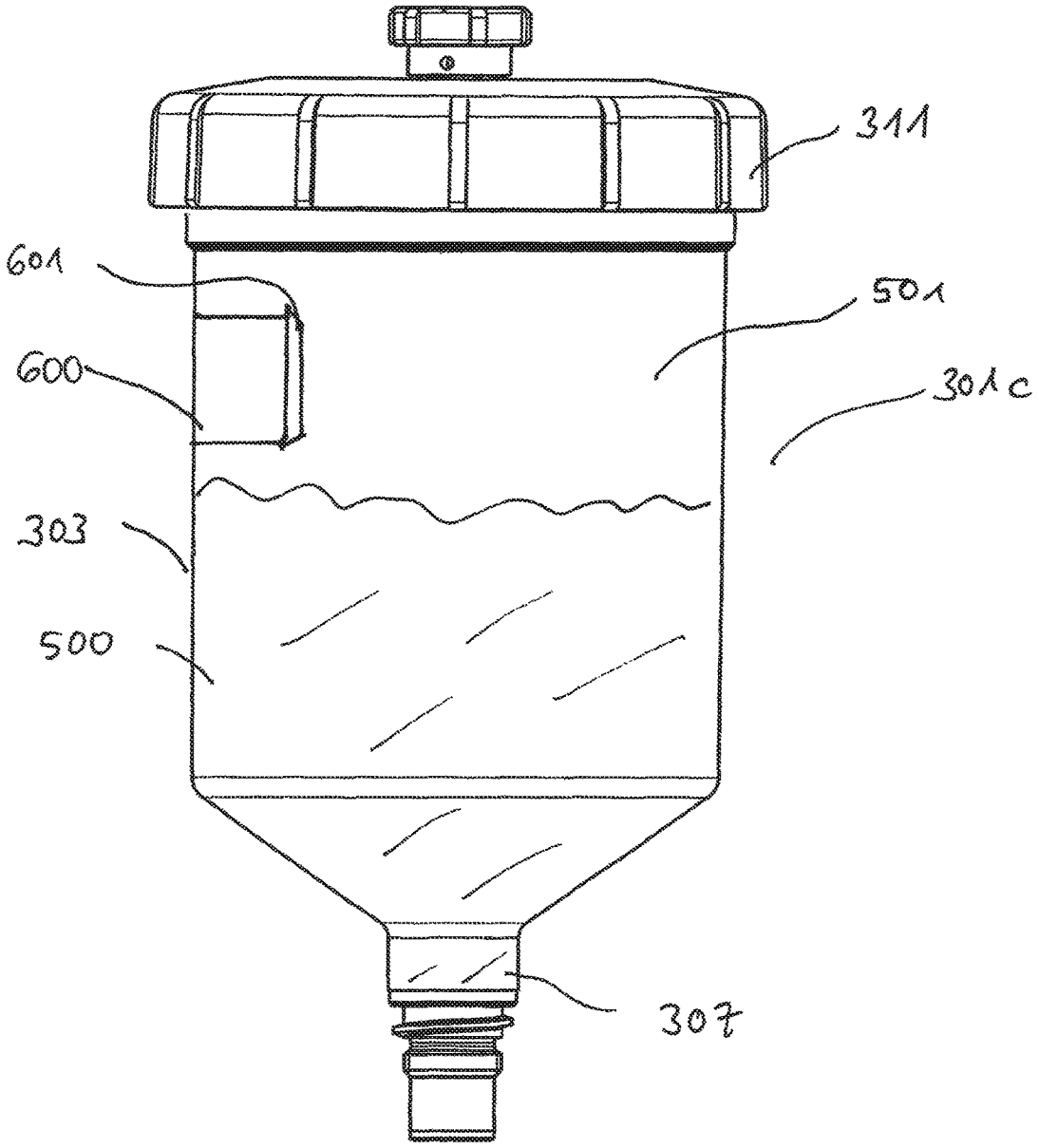

Shown in FIG. 6 is an exemplary embodiment in which the flow cup 301 shown in FIG. 1 is configured in a different way according to the invention. In this flow cup 301*c*, the same details as in the flow cup 301 according to FIG. 1 are designated by the same designations; their description can be taken from FIG. 1. The flow cup 301*c* is approximately half-filled with a relatively highly viscous paint liquid 500. In the flow cup 301*c* according to the invention, a box 600 is fixed to the inner side of the side wall of the cylinder 303, in particular bonded on. The box 600, shown only by way of illustration, has an openable cover 601 in the present exemplary embodiment. Diverse elements can be accommodated in the box 600 which, after the box 600 has been opened, escape from the latter and help in a manner supporting the force of gravity to lead the highly viscous liquid to the spray nozzle of the spray gun.

In a first variant of the flow cup 301*c*, the box 600 is equipped with an expandable plastic foam. As soon as the cover 601 of the box 600 is removed, the plastic foam propagates in the air space 501 over the paint liquid 500. As a result, the liquid 500 is forced well into the connecting piece 307 and onward into the spray gun.

Of course, care must be taken that a plastic foam that does not react chemically with the paint liquid 500 is chosen.

In the present exemplary embodiment, the removal of the cover 601 from the box 600 is started by means of an electronic timing device. This has the advantage that the cup

301*c* can be closed following the filling with paint and no longer needs to be opened if painting is to be begun with the pressure-assisted painting.

In a second variant of the flow cup 301*c*, the box 600 is a gas cartridge, not specifically illustrated, and is clipped into the cup 301*c*. The gas cartridge 600 is formed as a pierceable cartridge, which can be pierced by means of a spike, not illustrated. In the gas cartridge 600 there is an inert gas, specifically nitrogen. As soon as the gas cartridge 600 is actuated, the nitrogen propagates in the air space 501 over the paint liquid 500. As a result, the liquid 500 is forced well into the connecting piece 307 and onward into the spray gun.

Figure 7:
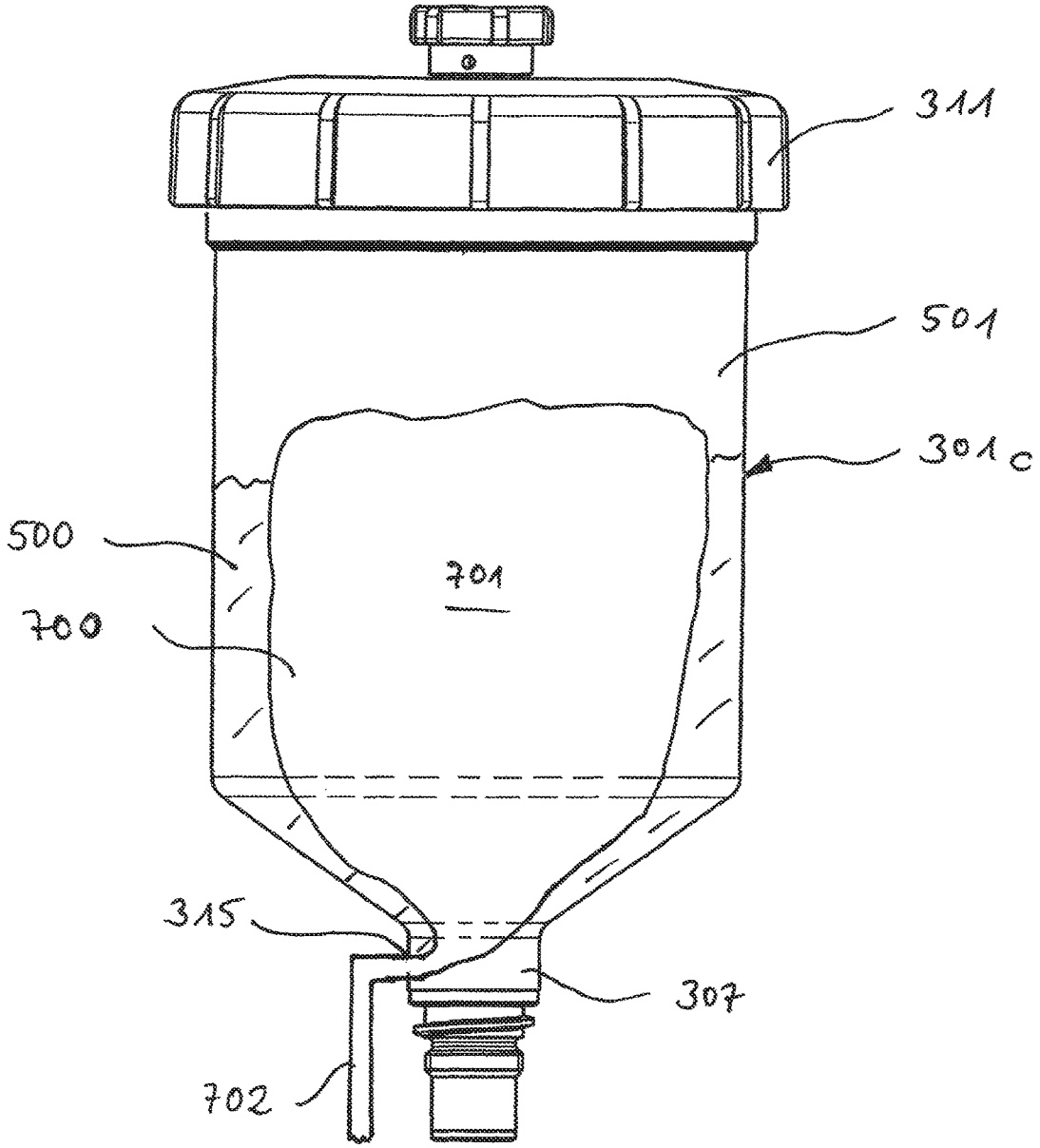

The third variant of the flow cup 301*c* is equipped with a gas bag 700 (see FIG. 7). In the present exemplary embodiment, the gas bag 700 consists of an extensible material having a non-linear elasticity which therefore at constant pressure inflates less highly at the start than subsequently (similar to an air balloon). In the present case, the gas bag 700 has an approximately spherical hollow space 701 and a tubular extension 702. The extension 702 is led through a lateral hole 315 which is provided in the connecting piece of the cup 301*c*. Guide elements and/or seals, not shown, ensure trouble-free seating of the gas bag 700 in the cup 301*c*. In a specific refinement, the extension 702 of the gas bag 700 can consist of another material, preferably of metal or a hard plastic, by which means the retention and the guidance in the hole 315 can be improved. The gas bag 700 can have compressed air applied thereto via the extension 702. The compressed air can originate from an external generator. Particularly preferably, it is to be derived from the compressed air stream of the spray gun. As a result, components and therefore costs are saved. Before the operation of the spray gun, the gas bag 700 is empty. Following the filling with compressed air, the hollow space 701 of the gas bag expands, as indicated in FIG. 7, and largely fills the interior of the cup 301*c*. As a result, the liquid 500 to be sprayed is forced well into the connecting piece 307 and onward into the spray gun.

In a further refinement of the invention, not illustrated, it is proposed to equip the gas bag as a double bag and to fill one bag with compressed air or the like and to equip the other bag with vacuum. By means of alternately opening and closing the two bags, the air chamber above the liquid to be sprayed can be moved in such a way that the liquid penetrates better than usual into the spray gun.

Figure 8:
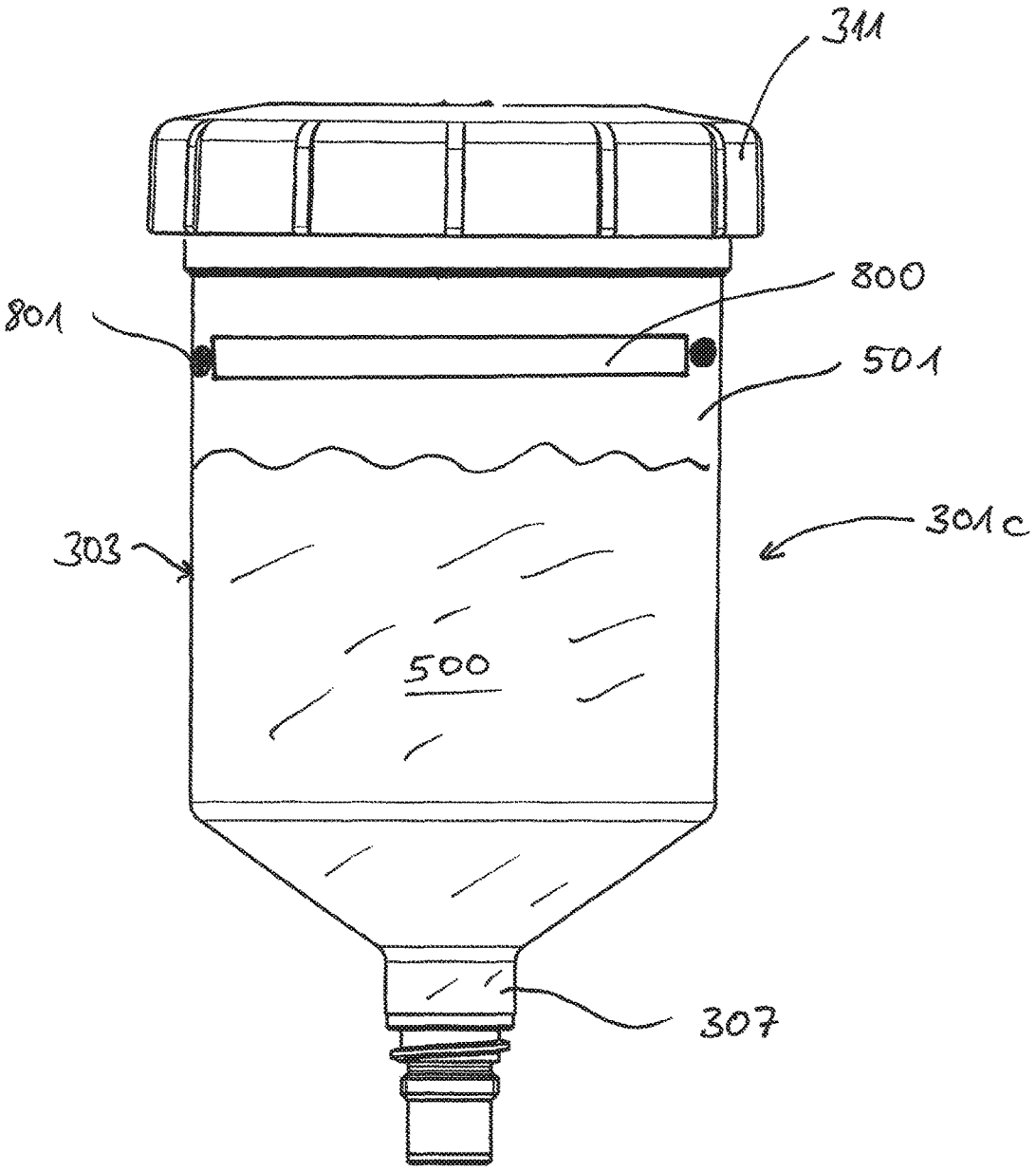

The fourth variant of the flow cup 301*c* according to the invention, illustrated in FIG. 8, is a mechanical solution with pressurization via a weight. The weight 800 used is a plate, which is preferably circular and which has a smaller diameter than the cylindrical area 303 of the flow cup 301*c*. Along its outer diameter, the plate 800 is equipped with a sliding ring 801, by means of which it is mounted such that it can be displaced in the manner of an intermediate floor along the inner wall of the cylinder 303. Following the introduction of compressed air into the air chamber 501, the plate 800 is displaced downward. The plate 800 can, for example, also be moved by means of a plunger, not illustrated, which is fixed to the cup cover 311. Following the downward movement of the plunger, the plate 800 displaces the air 501 above the liquid 500 to be sprayed. On the other hand, it is proposed to move the sliding ring 801 by means of magnetic force. For this purpose, the sliding ring 801 should be made of a magnetic material or contain magnetic material. A mating magnet could preferably run outside along the cylinder 303. Thus, in addition to the force of gravity, an additional compressive force can be exerted on the liquid 500 without difficulty, as a result of which the latter is forced well into the connecting piece 307 and onward into the spray gun.

The sliding ring 801 also ensures a sealing function. Instead of a ring, a single or double sealing lip, for example, could also be provided.

Figure 9:
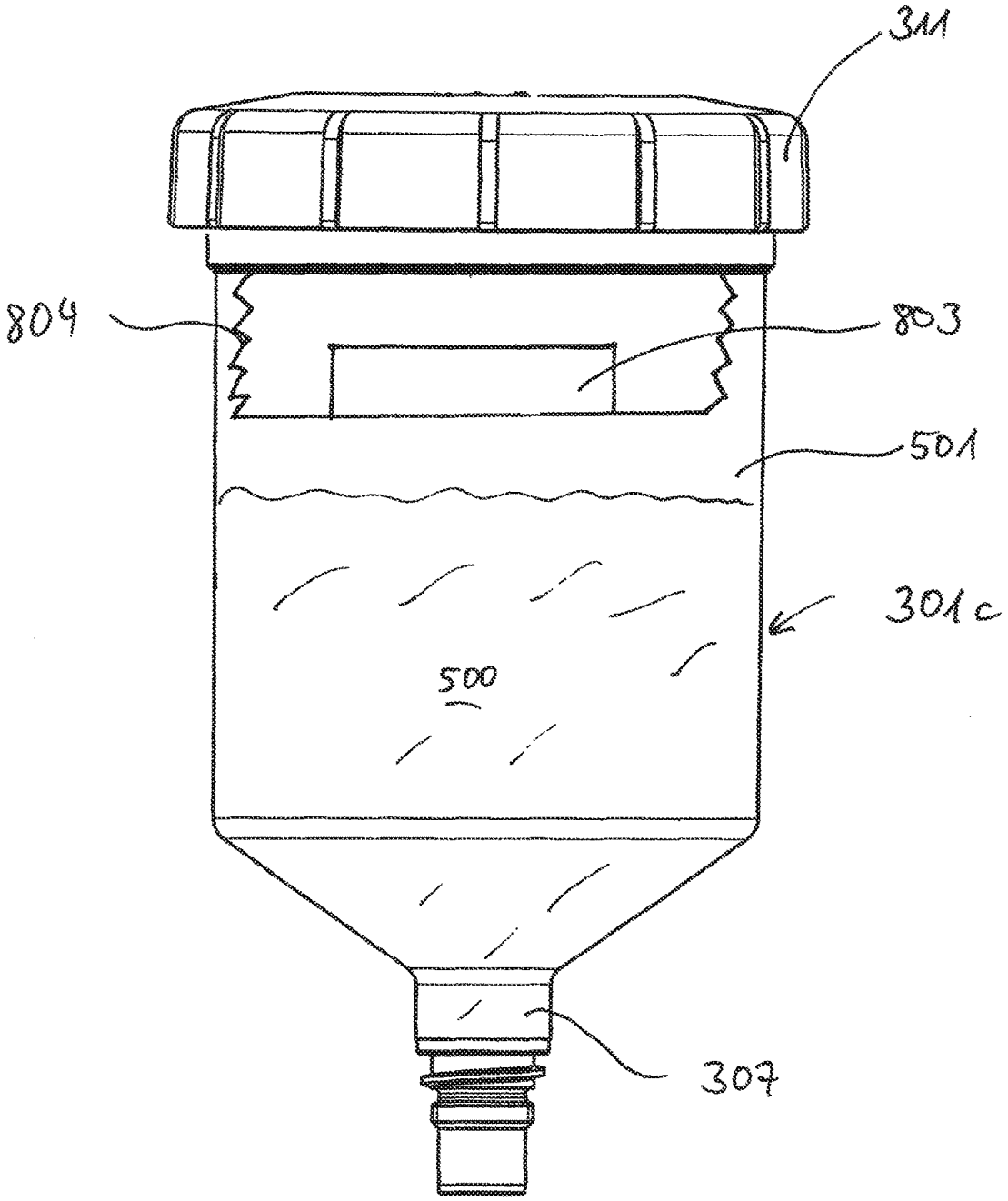

In the fifth variant of the flow cup 301*c* according to the invention, according to FIG. 9, the weight is formed by a block-shaped parallelepiped 803, which is accommodated in a bellows 804. The bellows 804 is fixed to the interior of the cup cover 311. After the cover 311 has been screwed on, the bellows 804 expands downward; the structure comprising bellows 804 and parallelepiped 803 a weight and displaces the air above the liquid 500 to be sprayed. As a result, in addition to the force of gravity, an additional compressive force is exerted on the liquid 500, as a result of which the latter is forced well into the connecting piece 307 and onward into the spray gun.

Figure 10:
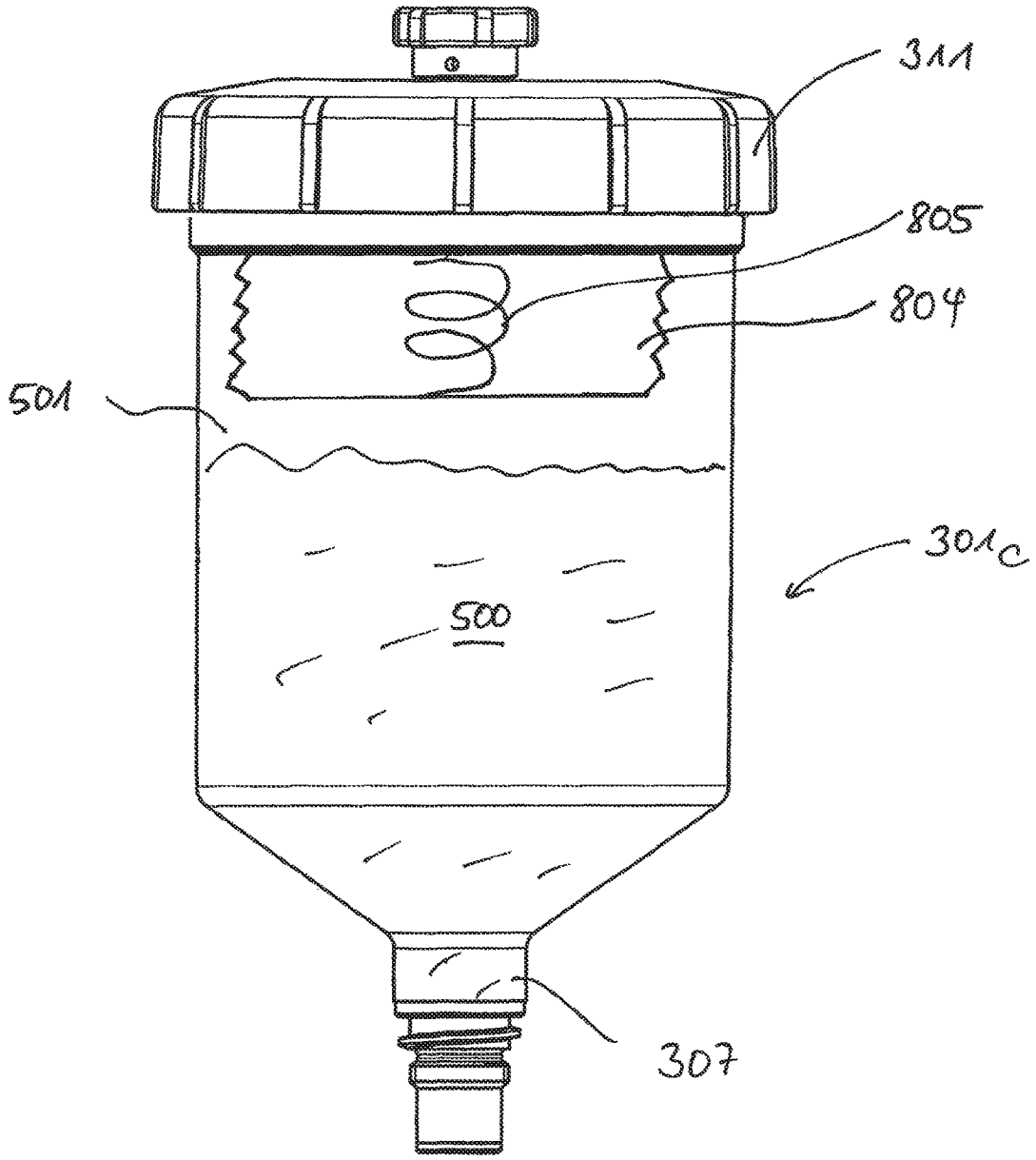

In the sixth variant of the flow cup 301*c* according to the invention, indicated in FIG. 10, the parallelepiped from FIG. 9 is replaced by a spring 805.

In these previously described mechanical variants, a clockwork mechanism or the like can also readily be provided in order to initiate the time of the pressure generation.

Figures 11, 11A:
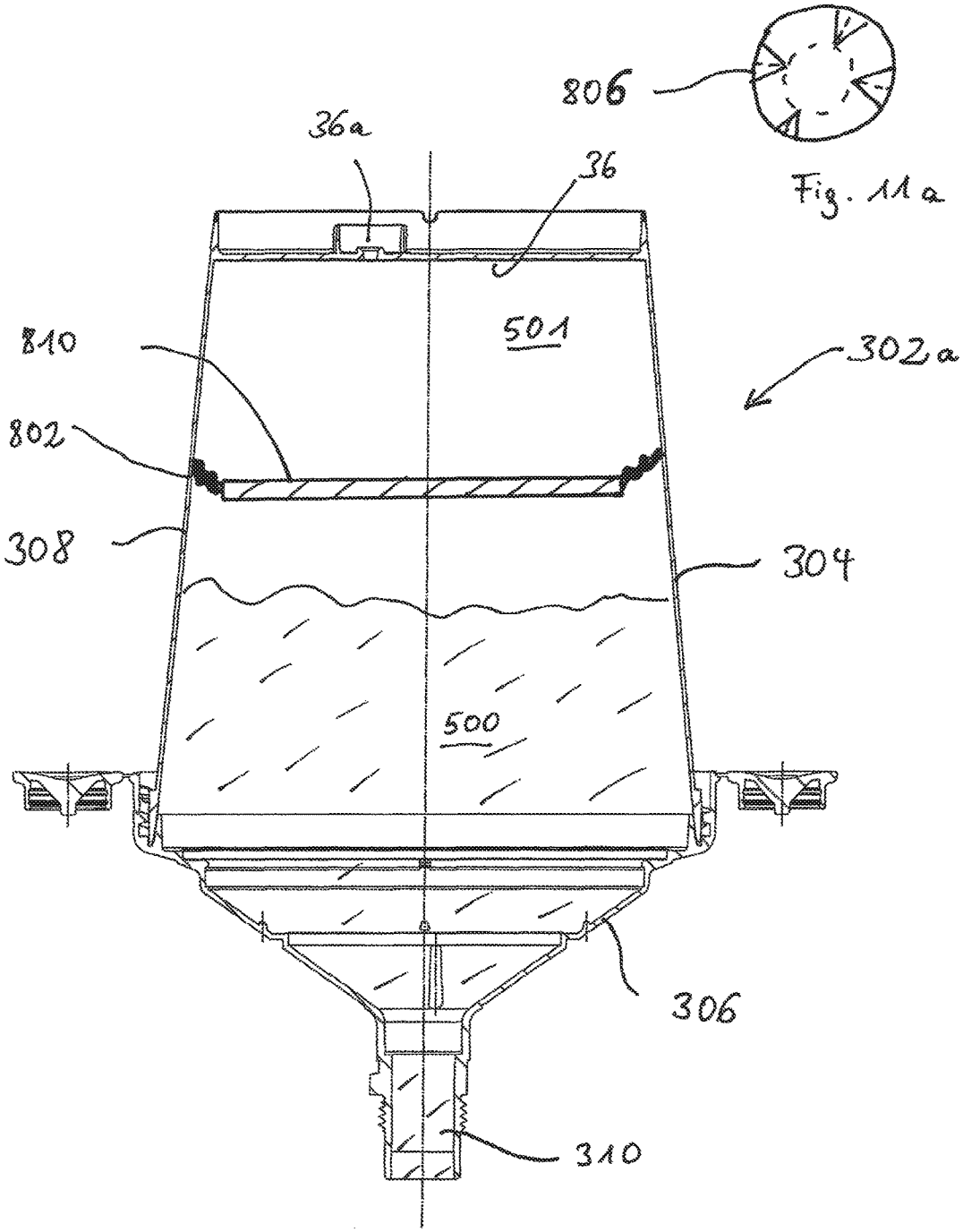

A seventh exemplary embodiment is shown in FIG. 11, in which the type of flow cup 302 shown in FIG. 2, a so-called "upside-down" flow cup, is configured in accordance with the invention.

The flow cup 302*a* initially has, as already known, a frustoconical color cup 304 and a similarly shaped cover 306 placed on the color cup 304 at the top. The cup 302*a* has a volume content of about 900 ml, is thin-walled, slightly elastically deformable on account of the low wall thickness and the material selected, is transparent and is provided with mixing scales (not shown) on a side wall 308. A ventilation valve 36 is provided on the base 36 of the cup. Here, the cover 306 is approximately half as high as the color cup 302*a*. Both the color cup 302*a* and the cover 306 are produced from plastic, as a rule injection molded. The cover 306 can be, but need not be, transparent or translucent. For production reasons and for mechanical stabilization, the cover can have some undercuts, gaps and ledges (not shown) on its inner side.

In its first configuration according to the invention, according to FIG. 11, the flow cup 302*a* is equipped with a movable intermediate floor 810, which is circular and which has a diameter which is smaller than the greatest internal diameter of the flow cup 302*a*. Along its circumference, the intermediate floor 810 is equipped with a sealing lip 802. The sealing lip 802 consists of an elastic material (e.g. rubber) and, by means of compression, can compensate completely for the diameter differences between the intermediate floor 810 and the inner wall of the flow cup 302*a* over the entire height of the latter. In one variant, the sealing lip can be formed as a double lip. In another variant, the lip or the intermediate floor can be provided with notches 806 (intended bending points) (see FIG. 11*a*). Following the introduction of compressed air into the air chamber 501, the intermediate floor 802 is displaced downward. As a result, in addition to the force of gravity, an additional compressive force is exerted on the liquid 500, by which means the latter is forced well into the connecting piece 310 in the cover 306 of the cup 302*a* and onward into the connecting piece, not shown here, of the spray gun and from there as far as the passage opening.

Figure 12:
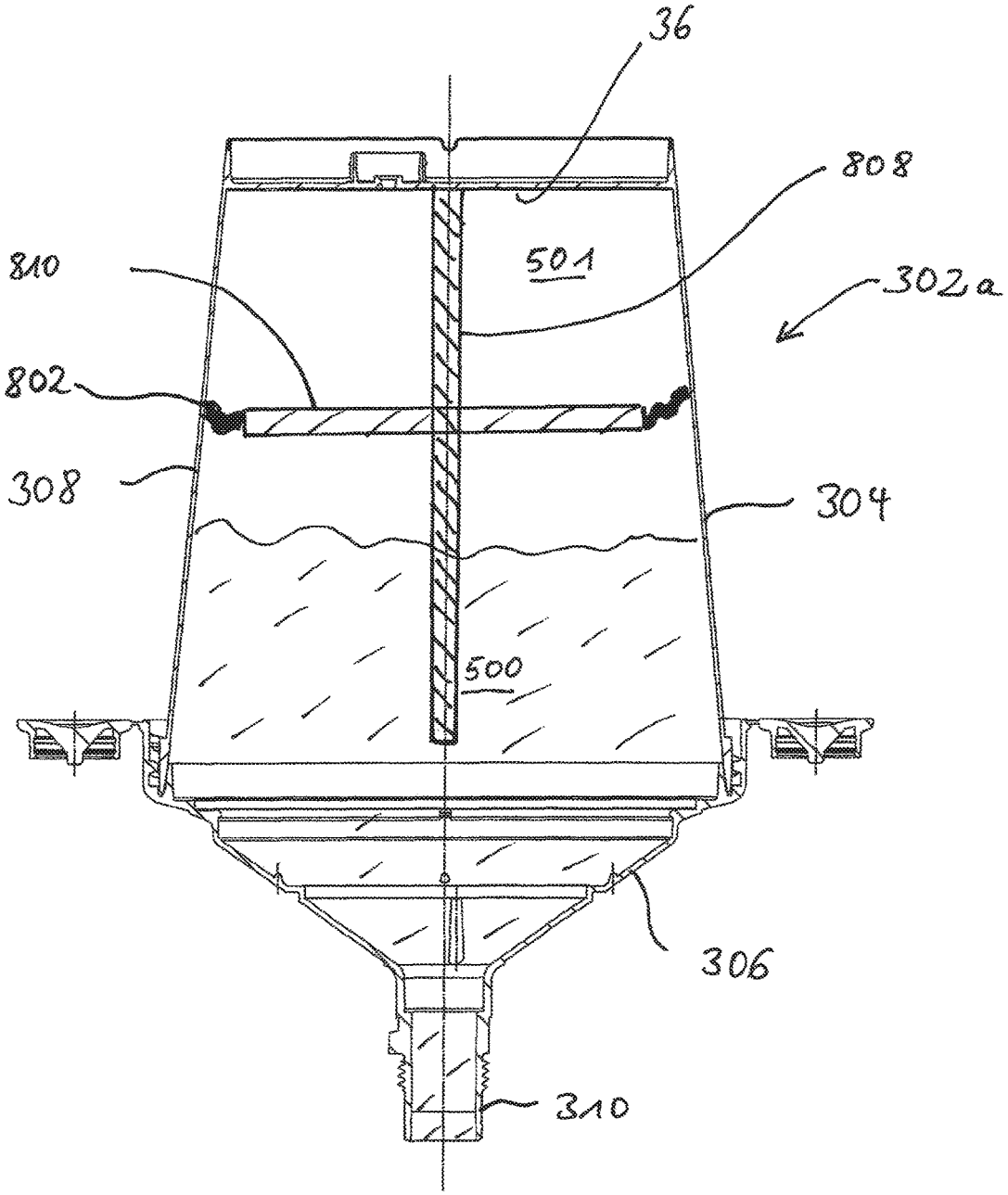

In the eighth variant, illustrated in FIG. 12, the intermediate floor 802 is penetrated centrally by a guide rod 808. By using the guide rod 808, undesired tilting of the intermediate floor 802 can be avoided. The guide rod 808 is adhesively bonded to the inner side of the cup base. Of course, the guide rod or another guide element for the intermediate floor 802 could also be fixed in another way or even not fixed to the cup base 36.

It is also proposed to provide the guide rod with an external thread and to fix the same in an opening in the cup base. As a result, the guidance of the intermediate floor can be improved further.

Figure 13:
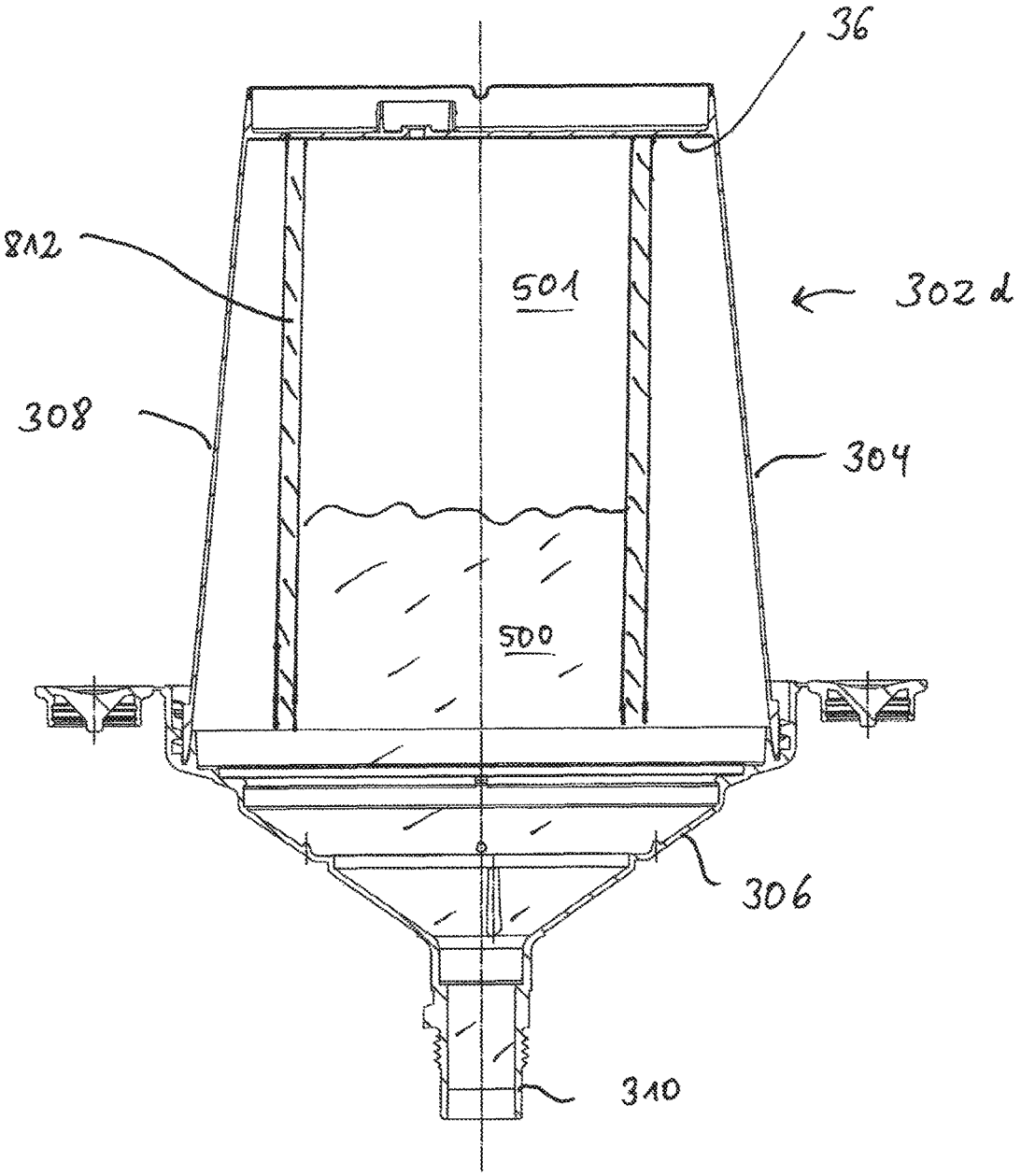

The ninth variant, illustrated in FIG. 13, is a flow cup 302*d* which corresponds substantially to the flow cups 302*a* shown in FIGS. 11 and 12. The flow cup 302*d* is, however, additionally equipped with a cylindrical insert 812. With the aid of the insert, an intermediate floor or the like can be guided more simply and securely than in the seventh and eighth variants. A further advantage is that the insert 812 increases the compressive strength of the flow cup 302*d*.

This insert can be an extruded part which preferably has reinforcing ribs, or a type of hose or a pipe. The insert can be transparent or translucent and can be provided with measuring scales on its outer surface.

At one end or at both ends, the insert 812 can be equipped with a seal.

The insert can have internal projections, grooves or the like, which can be used for latching to a pressure element.

Figure 14:
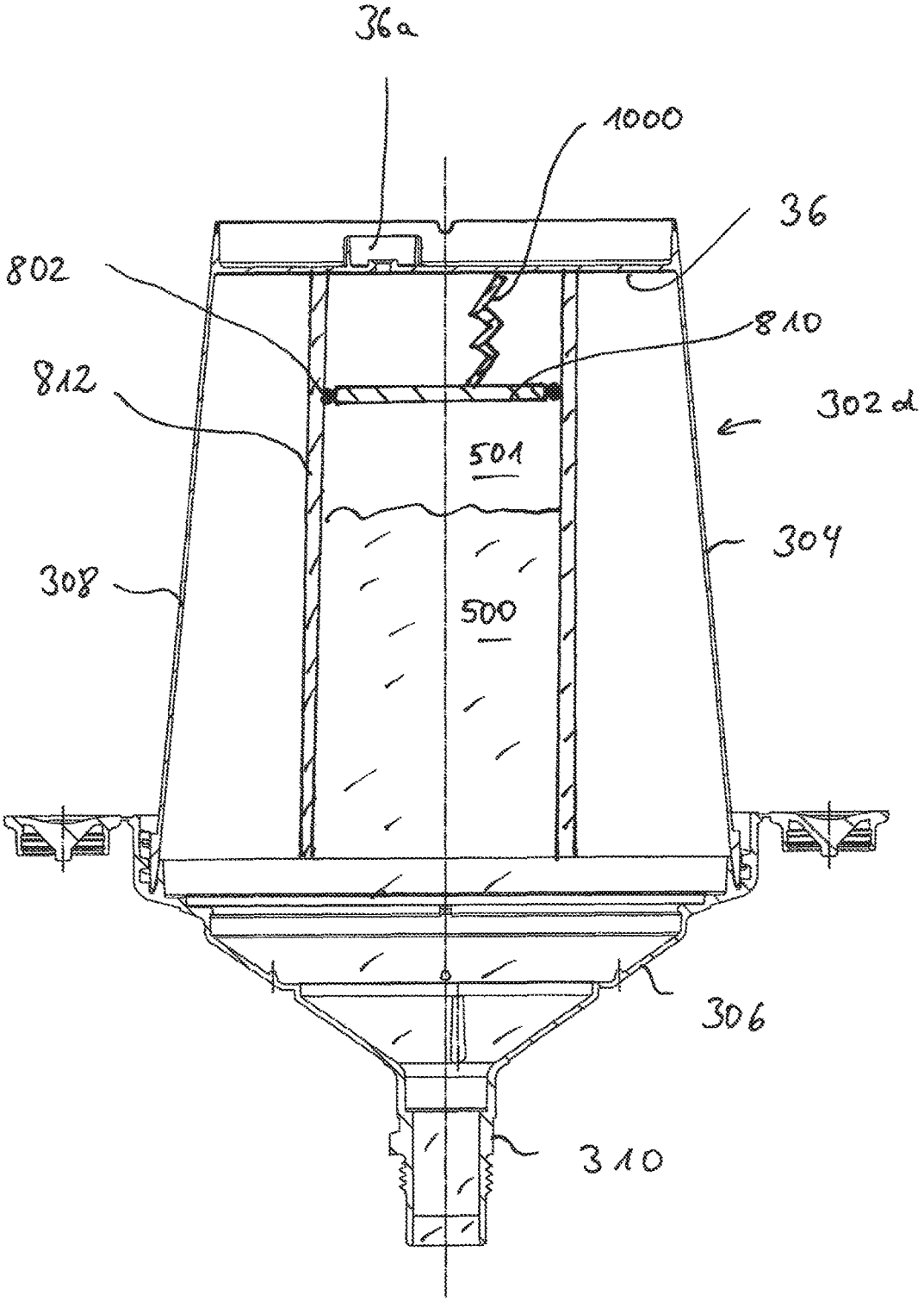

In the tenth variant, illustrated in FIG. 14, an intermediate floor 810 equipped with a sliding ring 802 is guided in a cylindrical insert 812. An additional generation of pressure is made possible by at least one tension/compression spring or by an extensible clockwork spring 1000.

In particular if the spring 1000 is configured as a clockwork spring, a combination with a guide rod with external thread, which is fixed in an opening in the cup base, is to be combined with a movable intermediate floor. When released, the rod then rotates with the intermediate floor in the cup.

During tensioning of the spring 1000 and after it has been pressed down, the intermediate floor 802*b* can be latched into diverse grooves, not shown, in the interior of the insert 812.

In another configuration, the ventilation valve 36*a* in the cup base 36 could be used for fixing, guiding and/or latching. Releasing the intermediate floor 810 could be affected by "the touch of a button" on the ventilation valve 36*a*.

Therefore, both the guidance of the intermediate floor 810 and also the quality of the pressure generation can be further secured and improved.

Figure 15:
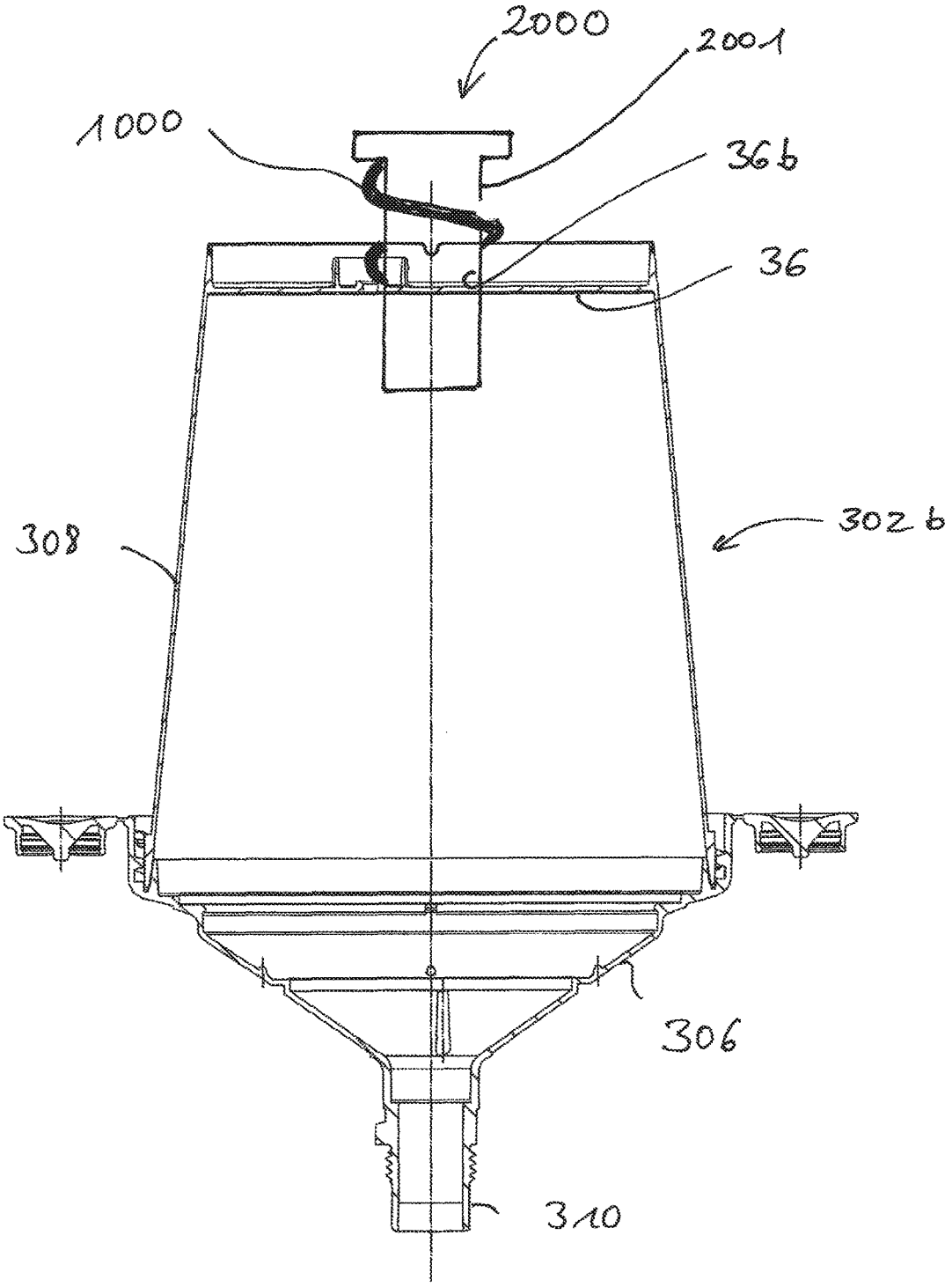

FIG. 15 indicates how the combination of a guide element 2000, such as a guide rod, with a clockwork spring 1000 could be configured constructively. The guide rod 2000 is equipped with an external thread 2001, which engages in an internal thread 36*b* in the cup base 36.

Figure 16:
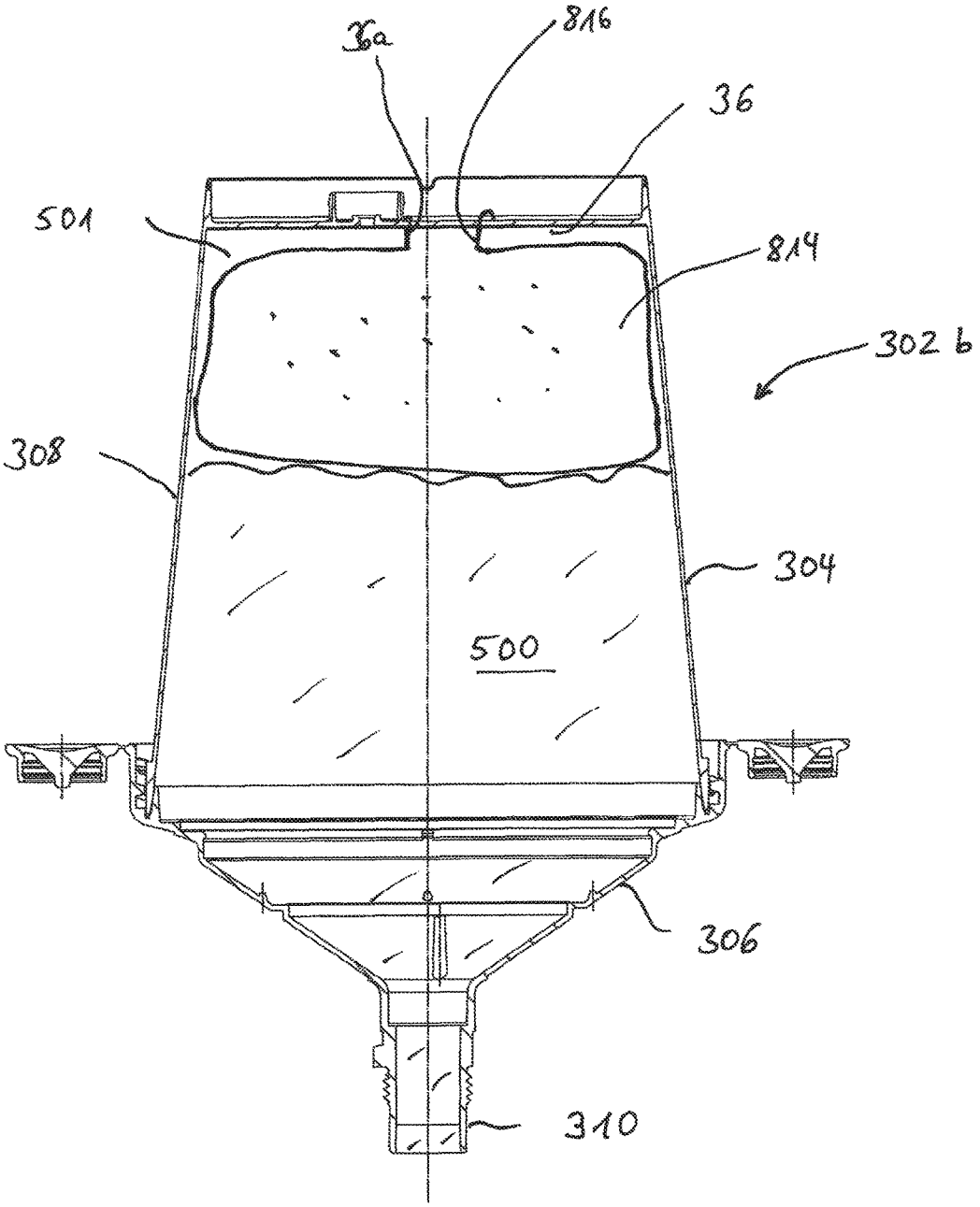

The twelfth variant, illustrated in FIG. 16, is once more a flow cup 302*b* which corresponds substantially to the flow cups 302*a* illustrated in FIGS. 11 and 12. However, instead of being equipped with an intermediate floor, it is equipped with a gas bag (air cushion) 814. The air cushion 814 has a predefined shape, which is preferably matched to the conical shape of the flow cup 302*b*. It consists of an extensible material with a nonlinear elasticity which, therefore, with constant pressure, is inflated less at the start than subsequently (similar to an air balloon). The air cushion 814 has an extension 816 which passes through a hole 36*a* in the cup base 36. Around this hole 36*a*, the air cushion 814 is fixed, preferably bonded, to the cup base 36 by means of its extension 816. The air cushion 814 can be loaded with compressed air via the extension 816. The compressed air can originate from an external generator, for example from a cartridge. Particularly preferably, it should be derived from the compressed air stream of the spray gun. As a result, components and therefore costs are saved. Before the operation of the spray gun, the cushion 814 is empty. After being filled with compressed air, the hollow space of the air cushion 814 expands, as indicated in FIG. 14, and largely fills the air chamber 501 of the cup 301*b*. As a result, the liquid 500 to be sprayed is forced particularly well into the connecting piece 310 in the cover 306 of the cup 302*b* and onward into the connecting piece, not shown, of the spray gun and from there as far as the passage opening.

In a further refinement of this embodiment, the combination of the air cushion 814 with an intermediate floor 802, which is preferably firmly connected to the air cushion 814, is proposed.

Figure 17:
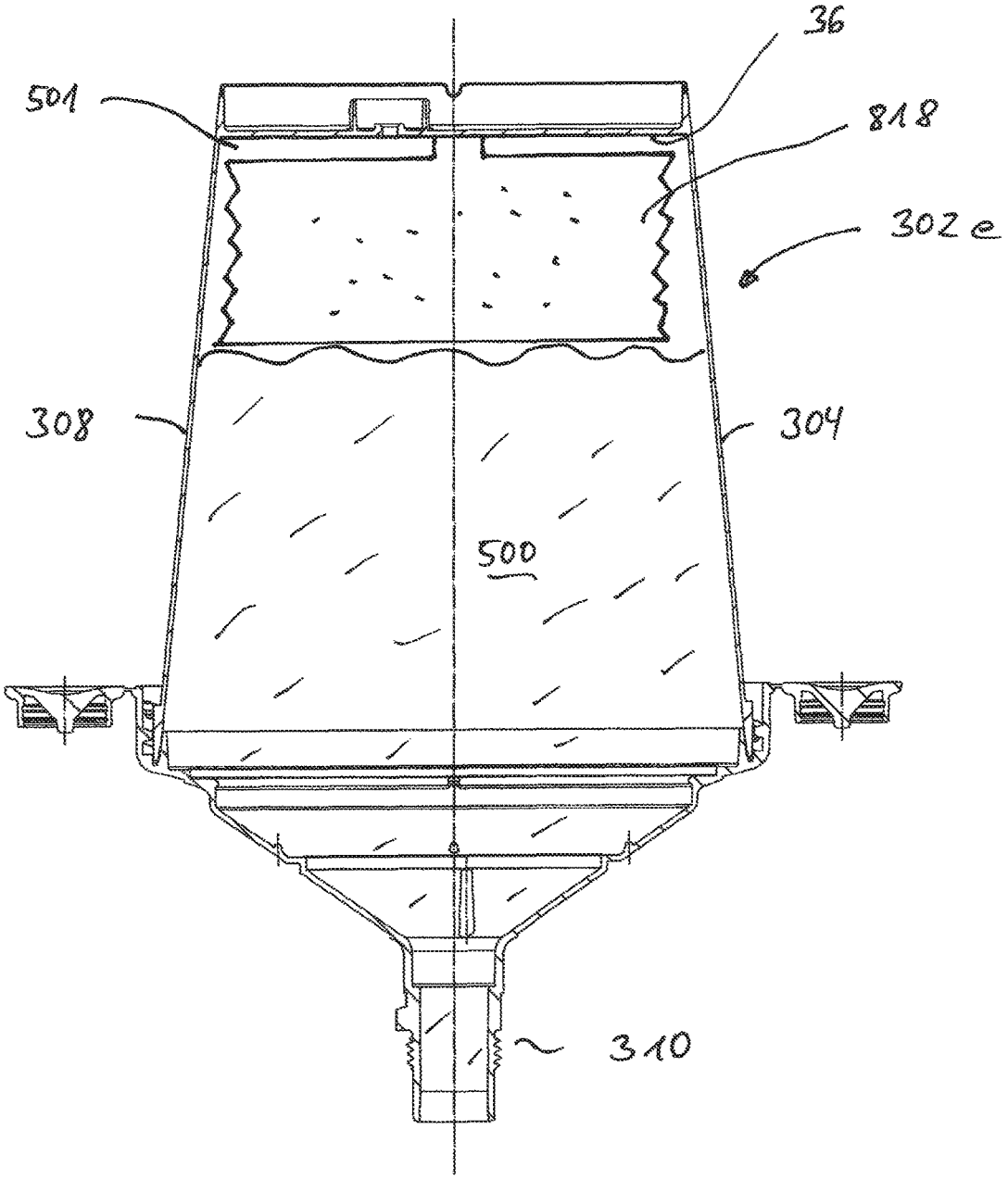

In the thirteenth variant, illustrated in FIG. 17, the gas bag is equipped as a bellows 818. It consists of an extensible material with a linear or nonlinear elasticity. Otherwise, the shape and function correspond to the twelfth variant.

Figure 18:
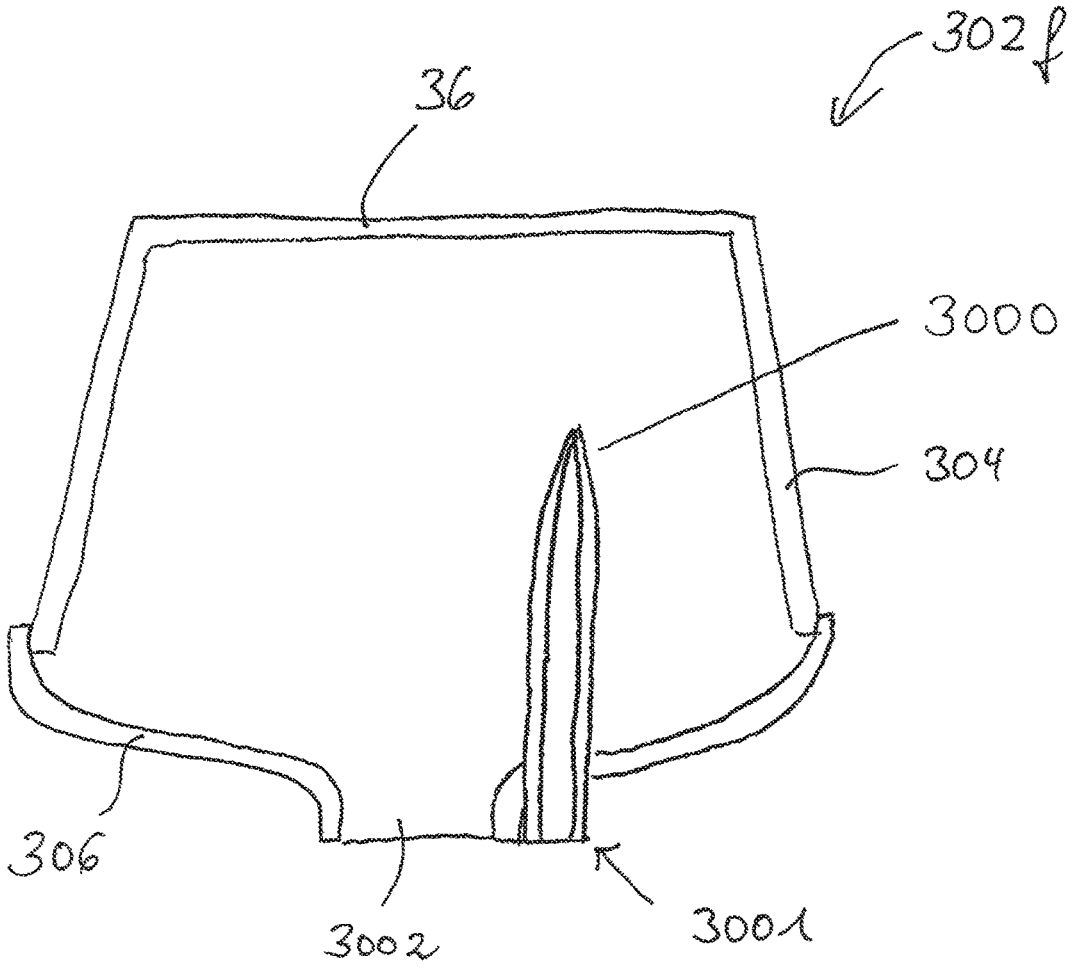

A fourteenth variant is indicated in FIG. 18. Here, a pressure connection 3001 with automatic sealing is provided in the cup cover 306. The flow cup 302*f*, like the "upside-down" flow cup previously illustrated, has a color cup 304 and a cover 306. The pressure connection 3001 is arranged eccentrically, i.e. at the side of the outlet duct 3002 opening into the connecting piece, not shown, for the liquid. The compressed air is preferably supplied from the spray gun. The pressure supply in the gun body must then be controlled (throttle) or regulated (pressure regulator). In the present exemplary embodiment, the flow cup 302*f* has a duck-bill valve 3000 with non-return function. As a result, a return flow of the liquid to be sprayed into the air region can be avoided very well.

By means of such a configuration, an unwantedly long compressed air hose connection can be avoided particularly effectively.

Figure 3:
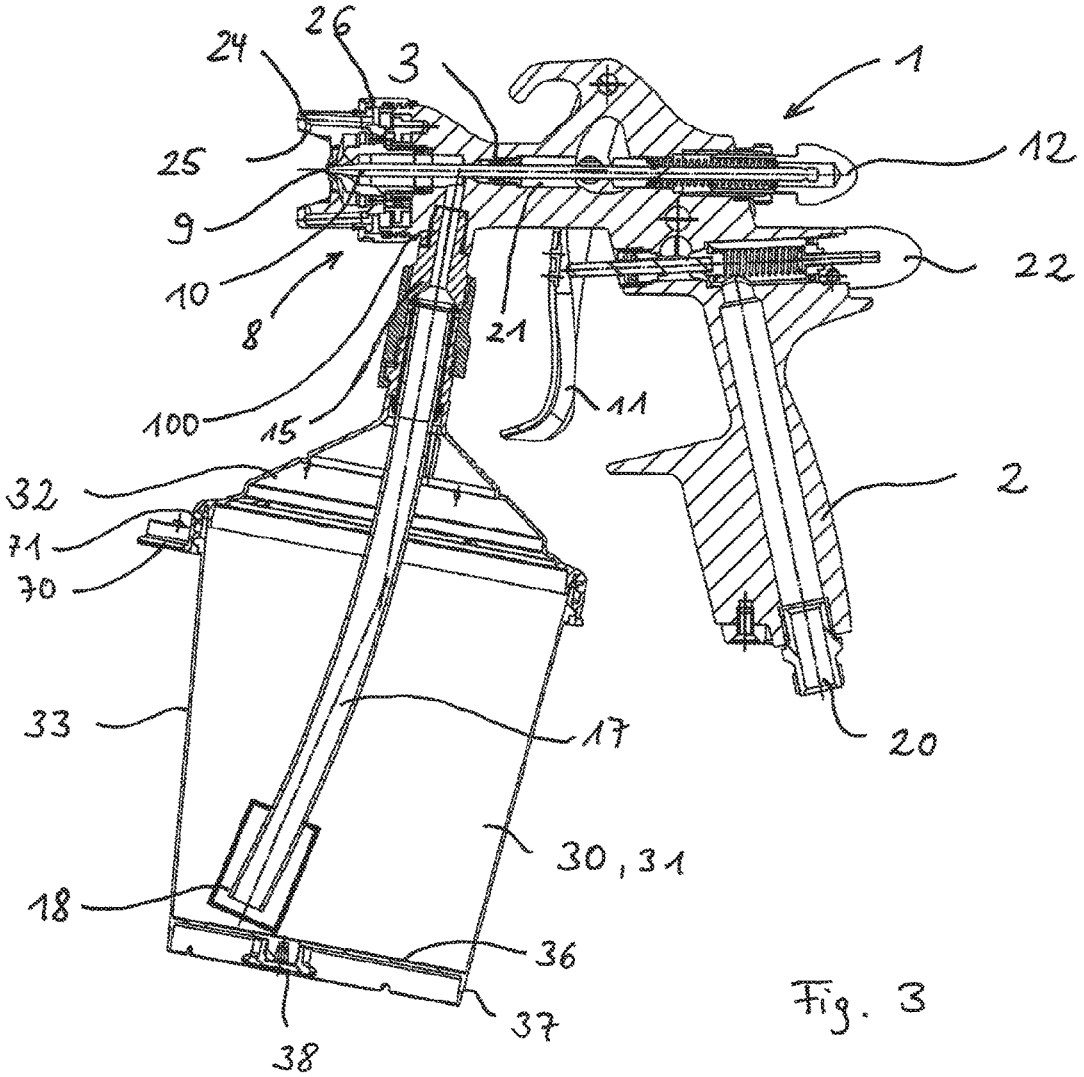
FIG. 3 shows a sectional view of a spray gun with a suspended cup.
Figure 19:
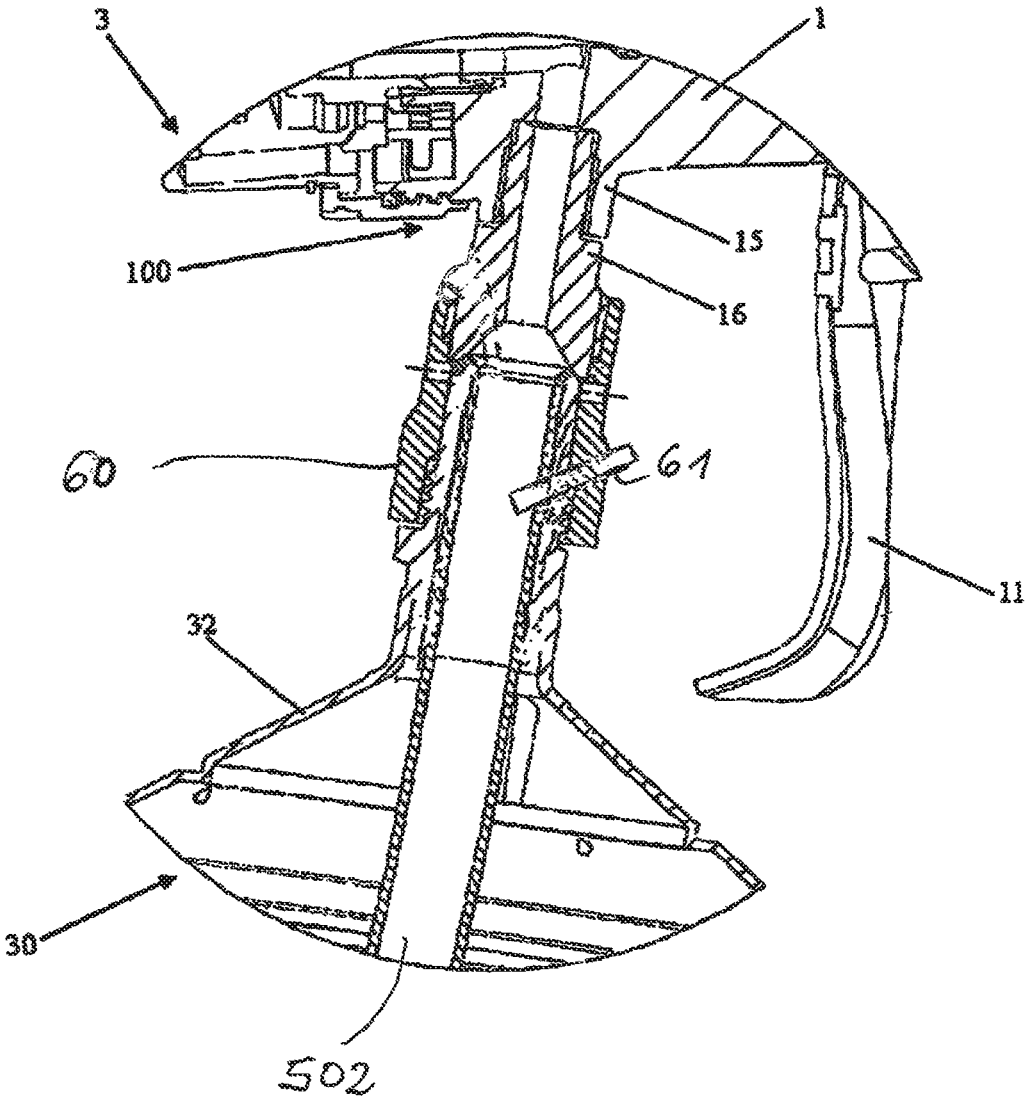
FIG. 19 shows a detailed view of a suspended cup configured in accordance with the invention.

A fourteenth exemplary embodiment is shown in FIG. 19, in which the assembly shown in FIG. 3 of a spray gun with a type of flow cup 30, a so-called "upside-down" flow cup, which is used as a suspended cup, is configured in accordance with the invention. Such an assembly between spray gun 1 and material container 30 is known from WO2013/131626 A1 from the applicant, the entire content of which is also the subject of the present application. In the following text, only the essential details needed to explain the present exemplary embodiment will therefore be repeated here.

In the exemplary embodiment according to FIGS. 3 and 19, an inlet region 100 for the material to be sprayed is located on the underside of the front end 8 of the head 3 of the spray gun. In the present exemplary embodiment, here a downwardly projecting, hollow connecting piece 15 for a container 30 for the material to be sprayed is molded on in one piece. The connecting piece 15 in the present exemplary embodiment is provided on the inside with a screw thread, into which a separate connecting piece 16, known per se, made of a sealing plastic material is screwed. Under certain circumstances, for example when the spray gun is produced from more or less elastic plastic material, it is possible to dispense with such a connecting piece 16. Detachably fixed to the connecting piece 16 is an intake hose 17 as a delivery element for the material to be sprayed. However, it could also be connected non-detachably to the connecting piece 16, the connecting piece 15 or another component.

The intake hose 17 in the present exemplary embodiment is produced from a transparent flexible plastic. On the other hand, however, a more or less rigid, transparent, translucent or opaque intake pipe made of plastic, metal or other material could also be used. At its lower, free end, the intake hose 17 is equipped with a filter 18. The filter 18 is bag-shaped here and consists of plastic material reinforced in some areas by ribs. Provided at its free end is a perforated plate 19, into which the intake hose 17 engages in a fitting manner. A non-detachable, possibly one-piece connection between the filter 18 and the intake hose 17 or the like can likewise be provided. The intake hose 17 dips far into the material to be sprayed, not illustrated, in the container 30.

The in container 30 shown has a frustoconical color cup 31 and a similarly shaped cover 32 placed on the color cup 31 at the top. The color cup 31 has a volume content of about 300, 600 or 900 ml, is thin-walled, slightly elastically deformable on account of the low wall thickness and of the material selected, is transparent and is provided on its side wall 33 with mixing scales (not shown). Here, the cover 32 is about half as high as the color cup 31. Both the color cup 31 and the cover 32 are produced from plastic, as a rule injection molded. The cover 32 can be but does not need to be transparent or translucent. For production reasons and for mechanical stabilization, the cover can have some undercuts, gaps and ledges (not shown) on its inner side.

The color cup 31 has a base 36 in the form of a circular disk, on which a supporting edge 37 is preferably molded in one piece, by means of which the color cup 31 can stand independently on a support. In the present exemplary embodiment, a ventilation mechanism 38 having a ventilation opening which can be closed by means of a valve is provided in the base 36 of the color cup 31. The valve of the ventilation mechanism 38 must of course always be closed when filling the color cup 31, when mixing the material to be sprayed and during use of the color cup 31 on a suspended cup gun, in order that no undesired material escape takes place. For the purpose of tight sealing, one of several cap elements 70 can help; in the present exemplary embodiment these are integrally molded in one piece on the cup cover 32 via a film hinge 71 that can be torn through manually.

According to the invention, between the spray gun 1 and the cup 30 there is provided an adapter 60, through which a small tube 61, which dips into the liquid duct 502, passes laterally. By means of the small tube 61, the cup 30 can have a vacuum applied. The vacuum can be generated previously by means of an external component, such as a vacuum pump. However, it is proposed to generate the vacuum via an air stream which is branched off from a secondary air stream of the compressed air supply of the spray gun.

Figure 20:
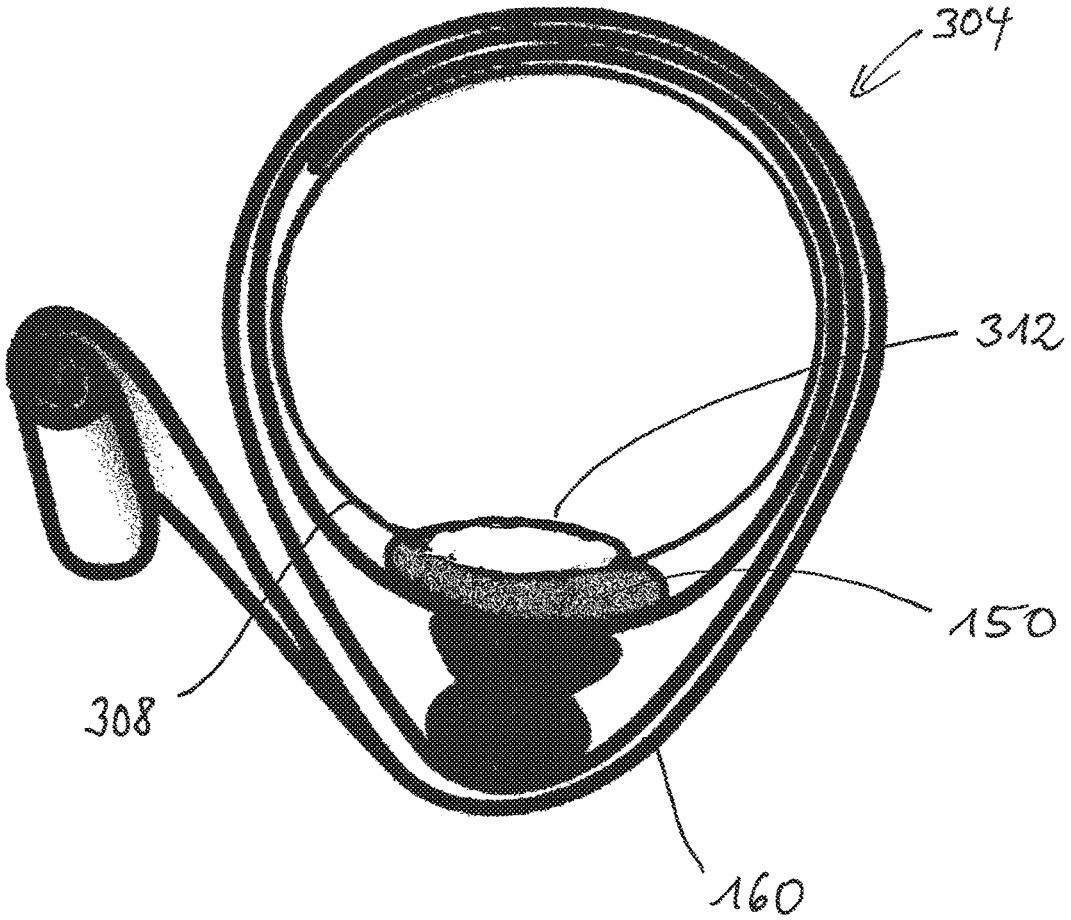
FIG. 20 shows a schematic view of another flow cup configured in accordance with the invention.

FIG. 20 indicates how pressure generation can be effected by means of a pressure pad 150. The pressure pad 150 comprises a solid body, is in principle formed like a plunger and acts from outside on the side wall 308 of the cup 304 of the material container. The latter consists of an elastic material, preferably of an elastic plastic.

The pressure pad 150 is firmly lashed with a tape 160 and can therefore when either be pressed continuously against the outer wall 308 or moved along this outer wall 308 as required. The pressure pad 150 then drives an indentation 312 into the outer wall 308. As a result, pressure is exerted on the interior of the material container. The hollow space in the cup is thus reduced; at the same time the air over the liquid to be sprayed and/or the liquid to be sprayed is displaced, specifically in such a way that it is forced well into the connecting piece in the cover or in the base of the cup and onward into the connecting piece of the spray gun and from there as far as the passage opening.

In another configuration of the invention, not illustrated, the pressure pad 150 is replaced by an inflatable cushion, an air balloon or the like. These variants have the advantage that exertion of a pressure of variable magnitude is made easier.

Figure 4:
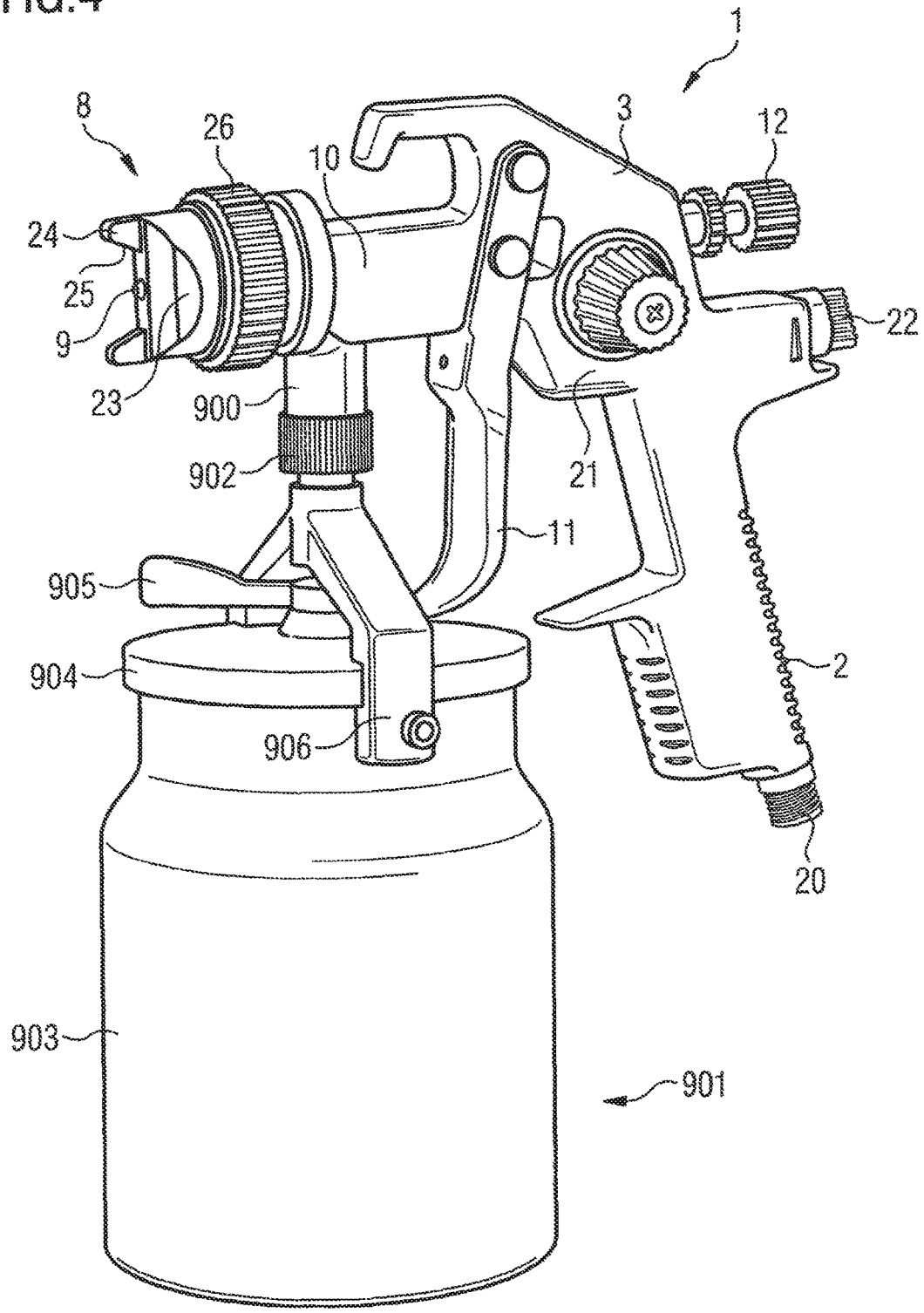
FIG. 4 shows a side view of a spray gun with another suspended cup.

In the following, the application of the invention to a spray gun is to be explained once more with another, more conventional suspended cup, as shown in FIG. 4.

As mentioned at the beginning, the spray gun according to the FIG. 4 is also a compressed air operated color spray gun. It has a gun body 1 with a handle area 2 and a head 3. These two sub-areas 2 and 3 extend at an angle of about 100 degrees relative to each other, as is usual. The handle area 2 has at its lower end a compressed air connection 20. Multiple air ducts 21 (not shown), which end at the front end 8 of the head 3 of the spray gun, extend from the compressed air connection 20 through the handle area 2 and through the head 3. The volume and the pressure of the air flowing through these air ducts 21 can be regulated in the usual way by means of an air micrometer 22. The front end 8 of the head 3 is equipped with an air nozzle 23, which has protruding horns 24 with openings 25. An air nozzle ring 26 retains the air nozzle 23 on the head 3 of the gun body 1.

The material to be sprayed is led through the front end 8 of the head 3 of the spray gun, in which a passage opening 9 for a color needle 10 is provided at the center. When the spray gun is not in use, the front end 8 of the head 3 is closed by a mechanism. The mechanism can be actuated by means of a trigger 11; the volume of material can be regulated via a device which has a regulating screw 12. The mechanism for the trigger 11 and the color needle 10 can be actuated in a force-fitting manner via springs, not illustrated.

Provided on the underside of the head 3 of the spray gun 1 is a connecting piece 900 for a container 901 the material to be sprayed. The connecting piece 900 is cylindrical and has an external thread, via which the material container 901, fitted with a mating thread, can be fixed by means of a connecting nut 902. The material container 901 is a conventional aluminum suction cup having a holding capacity of about 1 l. It has a cylindrical cup 903, which is closed by a likewise cylindrical cover 904. A locking mechanism 905 ensures reliable seating of the cover 904 on the cup.

In this cup 903, in addition to the liquid to be sprayed, a chemical substance (or a substance mixture) is introduced, by means of which pressure can be generated by means of gas development in accordance with the basic principles: shock pressure of an explosive substance or: effervescent tablet. Of course, the chemical substance and the liquid to be sprayed must not react with each other.

If possible, an inert gas like nitrogen must be produced as gas. Then, neither impairment of the quality of the material to be sprayed nor damage to the health of the user of the invention is to be feared.

In another refinement of the invention it is proposed to accommodate the chemical substance in a bag or the like. If, in addition, the bag has a much greater volume than the chemical substance, the "explosion" can take place in the bag. The chemical substance then does not come into contact at all with the liquid to be sprayed.

Of course, the material container 901 could also be equipped with another pressure generating element which has been described by using the exemplary embodiments described previously.

Figure 21:
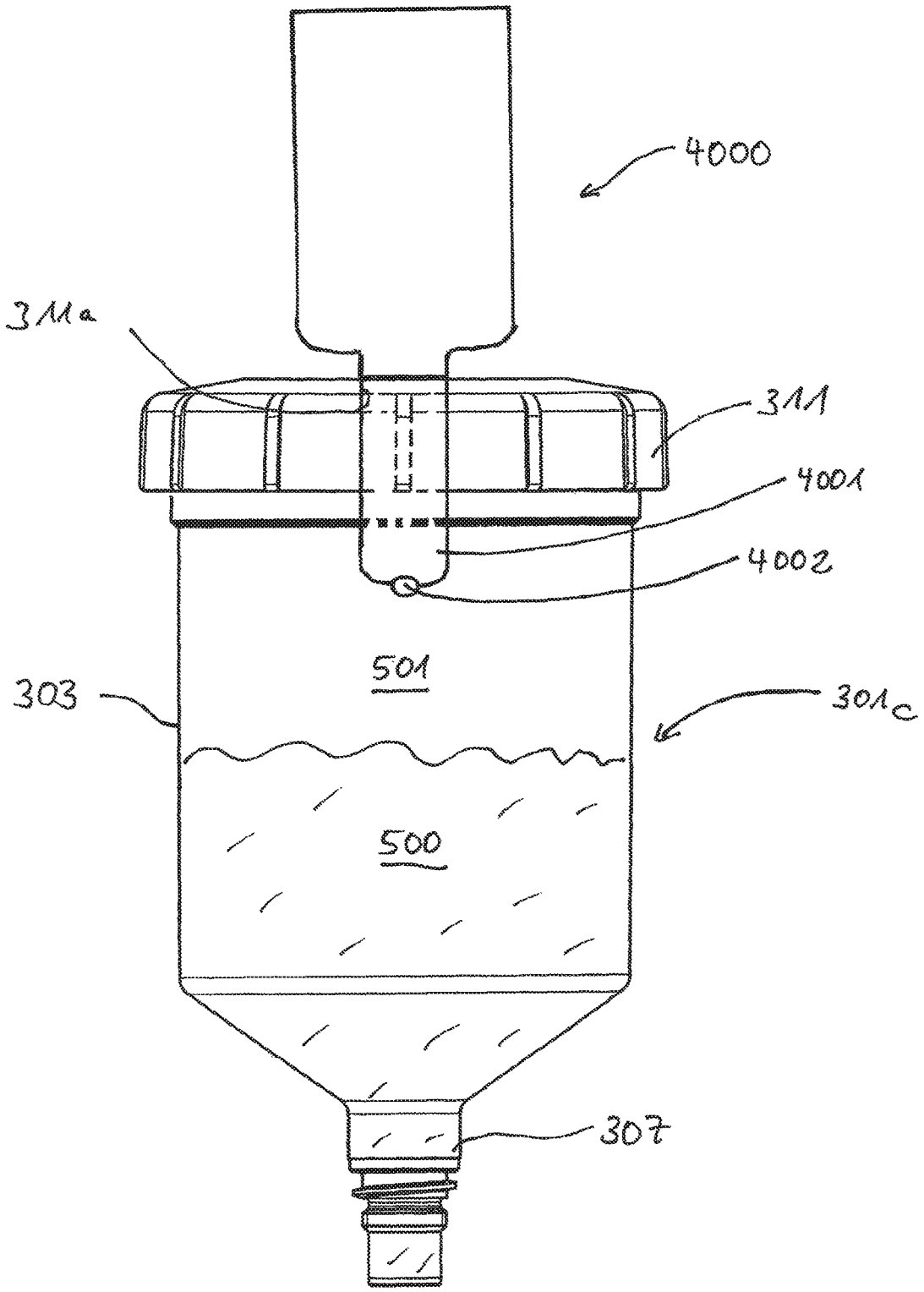

In the variant illustrated in FIG. 21 of the basically conventionally shaped flow cup 301*c*, a spray can 4000 is used as pressure generator. The spray can 4000 is led by its head 4001 through a central opening 311*a* in the container cover 311. The head 4001 of the spray can 4000 projects relatively far into the cup 301*c*. There is compressed air in the spray can 4000. As soon as the spray can 4000 is actuated, the air present therein flows out of the spray insert 4002 of the spray can 4000 and propagates in the air space 501 over the liquid 500 to be sprayed. The air from the spray can 4000 therefore enlarges the quantity of air in the flow cup 301*c* considerably. As a result, the liquid 500 is forced particularly well into the connecting piece 307 and onward into the spray gun.

Figure 22:
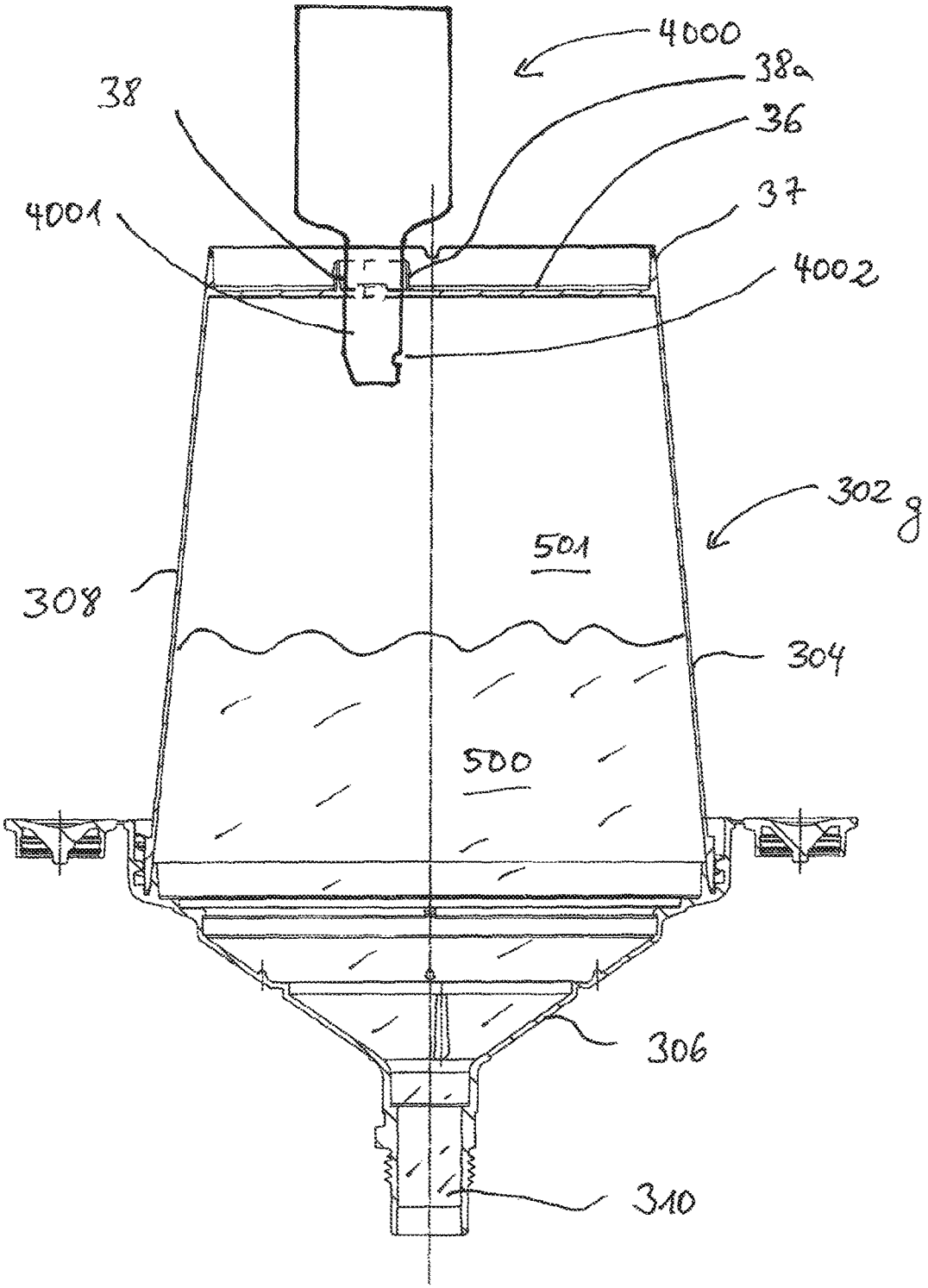

In FIG. 22, an "upside-down" flow cup according to the invention which is basically known and is very usual in painting guns is equipped with a spray can 4000 as pressure generator. The flow cup 302*g*, like the "upside-down" flow cup previously illustrated, has a color cup 304 and a cover 306. It also has a base in the shape of a circular disk, on which a supporting edge 37 is preferably molded in one piece, by means of which the color cup 302*g* can stand independently on a support. In the present exemplary embodiment, an opening 38 which can be closed by means of a valve in known "upside-down" flow cups, is provided in the base 36 of the color cup 302*g*. According to the invention, however, the spray can 4000 is inserted into the opening 38. This embodiment has the advantage that the basically known and usual "upside-down" flow cup does not have to undergo any constructional changes.

If the opening 38 is equipped with a guide tube 38*a* for a ventilation valve, as is usual, in the present case this guide tube 38*a* can serve to guide and hold the spray can 400. Extensions, grooves and/or threaded elements can also be present or provided. It is advantageous to provide a spike or the like in the area of the guide tube 38*a* or elsewhere. The spike can serve as a trigger when the spray can is inserted.

The embodiment shown here functions in substantially the same way as the previously described embodiment with the spray can 4000. As soon as it is actuated, the air present therein flows out of the spray insert 4002 of the spray can 4000 and propagates in the air space 501 over the liquid 500 to be sprayed. The air from the spray can 4000 therefore enlarges the quantity of air 501 above the liquid 500 in the flow cup 302*g* considerably. As a result, the liquid 500 can be forced particularly well into the connecting piece 310 and onward into the spray gun.

In another variant, not illustrated, the opening 38 in the cup base 36 is used as before as ventilation valve opening. The spray can or a gas cartridge is then plugged into another opening to be provided in the cup base.

Instead of a spray can, however, a mechanically operable pump, such as an air pump, could also be used.

Finally, it should be pointed out that, despite its explanation by using diverse exemplary embodiments, the invention is not restricted thereto but of course permits and comprises the combination of diverse described details.

The invention claimed is:

1. A spray material containing device for coating surfaces with a sprayed material using a spray gun, the device comprising:

a material container connectable to the spray gun, the container dimensioned to retain a supply of sprayed material; and a pressure generating element positioned on or only partially in the material container itself, and configured to one of (a) generate a displacement medium, and (b) release a displacement medium that is contained within the pressure generating element, into an interior of the material container so as to cause an increase in a pressure exerted upon the sprayed material within the container so as to force the sprayed material out of the container, the pressure generating element not connected to a remote source of pressurized medium, wherein the pressure generating element has a gas cartridge or is a gas cartridge or a spray can, the gas cartridge or spray can being able to be mounted and demounted at any time.

2. The device as claimed in claim 1, wherein the pressure generating element has a gas bag or the like.

3. The device as claimed in claim 2, wherein the gas bag is formed as a bellows.

4. The device as claimed in claim 1, wherein the pressure generating element is an expandable plastic foam.

5. The device of claim 1, wherein the pressure generating element includes a valve positioned in a cover or a base of the material container.

6. The device of claim 5, wherein the valve is configured as a nonreturn valve.

7. The device of claim 6, wherein the valve is a duck-bill type valve.

8. The device of claim 1, wherein the pressure generating element is initiated and/or controlled and/or regulated by a mechanical or electronic timing device or clockwork mechanism.

9. A spray gun system including a spray gun and the spray material containing device of claim 1, the material container of the spray material containing device being connected to the spray gun.

10. The device of claim 9, wherein an adapter is arranged between the spray gun and the material container, a low pressure (vacuum) being supplied to the material container via the adapter.

11. The device of claim 1, wherein the gas cartridge or spray can is able to be mounted and demounted while the material container is pressurized.

12. The device of claim 1, wherein the gas cartridge or spray can is mounted to a cover or a base of the material container such that at least a portion of the gas cartridge or spray can is located outside of the material container.

13. The device of claim 1, wherein the gas cartridge or spray can is provided with a thread, the gas cartridge or spray can being mounted by screwing the thread onto a corresponding connection on the material container.

14. The device of claim 1, further comprising a low pressure (vacuum) that is applied to the material container.

15. The device of claim 14, wherein the low pressure (vacuum) is generated by an external component.

16. A spray material containing device for coating surfaces with a sprayed material using a spray gun, the device comprising:

a material container connectable to the spray gun, the container dimensioned to retain a supply of sprayed material; and a pressure generating element positioned on or in the material container itself, and configured to one of (a) generate a displacement medium, and (b) release a displacement medium that is contained within the pressure generating element, into an interior of the material container to thereby cause an increase in a pressure exerted upon the sprayed material within the container to thereby force the sprayed material out of the container, the pressure generating element not connected to a remote source of pressurized medium, wherein the pressure generating element is a pump.

17. The device of claim 16, wherein the pump is configured as one of a displacer pump, and a diaphragm pump.

18. The device of claim 16, wherein the pump is an electrically driveable diaphragm pump.

19. A spray material containing device for coating surfaces with a sprayed material using a spray gun, the device comprising:

a material container connectable to the spray gun, the container dimensioned to retain a supply of sprayed material; and a pressure generating element positioned on or only partially in the material container itself, and configured to generate a displacement medium by releasing at least one reactive chemical into an interior of the material container to produce at least one of a foam, a gas, or an effervescence within the material container so as to cause an increase in a pressure exerted upon the sprayed material within the container so as to force the sprayed material out of the container, the pressure generating element not connected to a remote source of reactive chemical, wherein a ventilation mechanism including a ventilation opening is provided in a base of the material container, and the pressure generating element is connected to the material container via the ventilation opening.

20. A spray material containing device for coating surfaces with a sprayed material using a spray gun, the device comprising:

a material container connectable to the spray gun, the container dimensioned to retain a supply of sprayed material; and a pressure generating element positioned on or only partially in the material container itself, and configured to generate a displacement medium by releasing compressed gas contained within the pressure generating element to release gas into an interior of the material container so as to cause an increase in a pressure exerted upon the sprayed material within the container so as to force the sprayed material out of the container, the pressure generating element not connected to a remote source of pressurized gas, wherein a ventilation mechanism including a ventilation opening is provided in a base of the material container, and the pressure generating element is connected to the material container via the ventilation opening.

21. The device of claim 20, wherein the pressure generating element comprises a cannister of compressed gas, a portion of the cannister of compressed gas including an outlet is passed into the interior of the material container, and another portion of the cannister of compressed gas is located outside of the material container.

22. The device as claimed in claim 20, wherein the pressure generating element has a shape matched to the material container.

23. The device of claim 20, further including a movable intermediate floor in the material container that is displaced by the displacement medium.

24. The device as claimed in claim 23, wherein the intermediate floor can be moved solely by the release of compressed air by the pressure generating element.

25. The device of claim 23, wherein the intermediate floor is guided by a guide rod.

26. The device as claimed in claim 23, wherein the intermediate floor is formed as a pressure plate.

27. The device of claim 25, wherein the guide rod is connected to a removable cover or a base of the material container.

28. The device of claim 23, wherein the pressure generating element includes a gas bag, and the intermediate floor is connected to the gas bag.

29. The device as claimed in claim 23, wherein the intermediate floor is equipped with a seal.

* * * * *